US007753176B2

(12) United States Patent
Kigawa et al.

(10) Patent No.: US 7,753,176 B2
(45) Date of Patent: Jul. 13, 2010

(54) EMERGENCY STOP SYSTEM OF ELEVATOR

(75) Inventors: Hiroshi Kigawa, Tokyo (JP); Tsunehiro Higashinaka, Tokyo (JP); Mineo Okada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 851 days.

(21) Appl. No.: 10/582,514

(22) PCT Filed: Apr. 20, 2004

(86) PCT No.: PCT/JP2004/005653

§ 371 (c)(1),
(2), (4) Date: Jun. 9, 2006

(87) PCT Pub. No.: WO2005/102899

PCT Pub. Date: Nov. 3, 2005

(65) Prior Publication Data

US 2007/0181378 A1 Aug. 9, 2007

(51) Int. Cl.
*B66B 5/06* (2006.01)

(52) U.S. Cl. ..... 187/286; 187/280; 187/287; 187/305; 187/373; 187/376

(58) Field of Classification Search ..... 187/280, 187/286, 287, 305, 373, 376
See application file for complete search history.

(56) References Cited

U.S. PATENT DOCUMENTS 3,012,634 A * 12/1961 Stelzer ..... 187/262
3,441,107 A * 4/1969 Dingfeld et al. ..... 187/376
4,531,617 A * 7/1985 Martin et al. ..... 187/373
RE33,171 E * 2/1990 Ogasawara et al. ..... 187/286
4,923,055 A * 5/1990 Holland ..... 187/287
5,040,639 A * 8/1991 Watanabe et al. ..... 187/275
5,052,523 A * 10/1991 Ericson ..... 187/350

(Continued)

FOREIGN PATENT DOCUMENTS

CA 2067284 1/1993

(Continued)

OTHER PUBLICATIONS

KR 2001105482 A original document.*

(Continued)

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

In an emergency stop system for an elevator, a governor sheave that moves in synchronism with the raising and lowering of a car is wound around a governor sheave. The car is mounted with a safety device for braking the car through displacement of the car, which is connected to the governor rope, with respect to the governor rope. A control device outputs an activation signal upon detecting an abnormality in the speed of the car. A rope catching device is provided in the vicinity of the governor sheave. The rope catching device has an electromagnetic actuator that is activated upon input of the activation signal, and a restraining portion for restraining the governor rope upon the activation of the electromagnetic actuator.

12 Claims, 14 Drawing Sheets

U.S. PATENT DOCUMENTS

| | | | | | |
|---|---|---|---|---|---|
| 5,183,979 | A * | 2/1993 | Sheridan et al. | 187/280 |
| 5,228,540 | A * | 7/1993 | Glaser | 187/355 |
| 5,281,774 | A * | 1/1994 | Masaki | 187/286 |
| 5,285,027 | A * | 2/1994 | Nakamura et al. | 187/275 |
| 5,299,661 | A * | 4/1994 | Pramanik et al. | 187/373 |
| 5,301,773 | A * | 4/1994 | Jamieson et al. | 187/376 |
| 5,458,216 | A * | 10/1995 | Tanaka et al. | 187/373 |
| 5,492,200 | A * | 2/1996 | Korhonen | 187/350 |
| 5,686,707 | A * | 11/1997 | Iijima | 187/291 |
| 5,869,794 | A * | 2/1999 | Spiess | 187/287 |
| 6,161,653 | A * | 12/2000 | Skalski et al. | 187/305 |
| 6,318,507 | B1 * | 11/2001 | Jin | 187/376 |
| 6,345,696 | B1 * | 2/2002 | Yumura | 187/287 |
| 6,360,847 | B1 * | 3/2002 | Okada et al. | 187/373 |
| 7,228,943 | B2 * | 6/2007 | Kugiya et al. | 187/393 |
| 2002/0117357 | A1 * | 8/2002 | Hugel | 187/376 |
| 2003/0024771 | A1 * | 2/2003 | Takai et al. | 187/373 |
| 2003/0042079 | A1 * | 3/2003 | Sanchez et al. | 187/373 |
| 2003/0070881 | A1 * | 4/2003 | Nagata et al. | 187/289 |
| 2003/0106747 | A1 * | 6/2003 | Sasaki | 187/373 |
| 2003/0183457 | A1 * | 10/2003 | Maury et al. | 187/250 |
| 2004/0079591 | A1 * | 4/2004 | Mueller | 187/287 |
| 2004/0173413 | A1 * | 9/2004 | Angst et al. | 187/287 |

FOREIGN PATENT DOCUMENTS

| | | | |
|---|---|---|---|
| JP | 52 123052 | | 10/1977 |
| JP | 53080648 | A * | 7/1978 |
| JP | 29754 1983 | | 2/1983 |
| JP | 59 74875 | | 4/1984 |
| JP | 9 2756 | | 1/1997 |
| JP | 10 109842 | | 4/1998 |
| JP | 2001-80838 | | 3/2001 |
| JP | 2001 122549 | | 5/2001 |
| JP | 2001 354372 | | 12/2001 |
| JP | 2002 179353 | | 6/2002 |
| JP | 2002 532366 | | 10/2002 |
| JP | 2003 104648 | | 4/2003 |
| KR | 2001105482 | A * | 11/2001 |
| KR | 2004029816 | A * | 4/2004 |
| WO | WO 03029123 | A1 * | 4/2003 |

OTHER PUBLICATIONS

KR 2001105482 A machine translation.*

* cited by examiner

EMERGENCY STOP SYSTEM OF ELEVATOR

TECHNICAL FIELD

The present invention relates to an emergency stop system for an elevator for forcibly stopping a car that is travelling at an abnormal speed.

BACKGROUND ART

As disclosed in, for example, JP 2002-532366A, in conventional elevator apparatuses, a ropeless governor activated by an electromagnet is often used to prevent a car from falling. A safety brake system is coupled to the ropeless governor. The ropeless governor comes into contact with a rail through activation of the electromagnet. The safety brake system is activated by a resistance force generated by the contact of the ropeless governor with the rail. In this way, braking is applied to the car.

In those elevator apparatuses, frequent performance tests are required to enhance the reliability of the performance of the ropeless governor. Each time such a performance test is carried out, the rope governor makes a strong contact with the rail, so the rail suffers much wear and damage, resulting in reduced life of the rail. As described above, the contact of the ropeless governor with the rail hinders an increase in the life of the safety brake system.

DISCLOSURE OF THE INVENTION

The present invention has been made to solve the above-mentioned problems, and therefore it is an object of the present invention to provide an emergency stop system for an elevator capable of achieving an increase in its life.

According to the present invention, an emergency stop system for an elevator includes: a detection portion for detecting a speed and a position of a car; a control portion having a storage portion that stores, in correspondence with the position of the car, an overspeed setting level set to be a value larger than the speed of the car during normal operation, the control portion outputting an activation signal when the speed of the car becomes higher than the overspeed setting level at the position of the car obtained based on information from the detection portion; a governor rope that moves in synchronism with raising and lowering of the car; a rope catching device having an electromagnetic actuator that is activated upon input of the activation signal, and a restraining portion that restrains the governor rope upon activation of the electromagnetic actuator; and a braking portion mounted in the car and having a braking member capable of coming into and out of contact with a guide rail for guiding the car, the braking portion braking the car by pressing the braking member against the guide rail when the governor rope is restrained and the car is displaced with respect to the governor rope.

BEST MODE FOR CARRYING OUT THE INVENTION

Hereinbelow, preferred embodiments of the present invention will be described with reference to the drawings.

Embodiment 1

Figure 1:
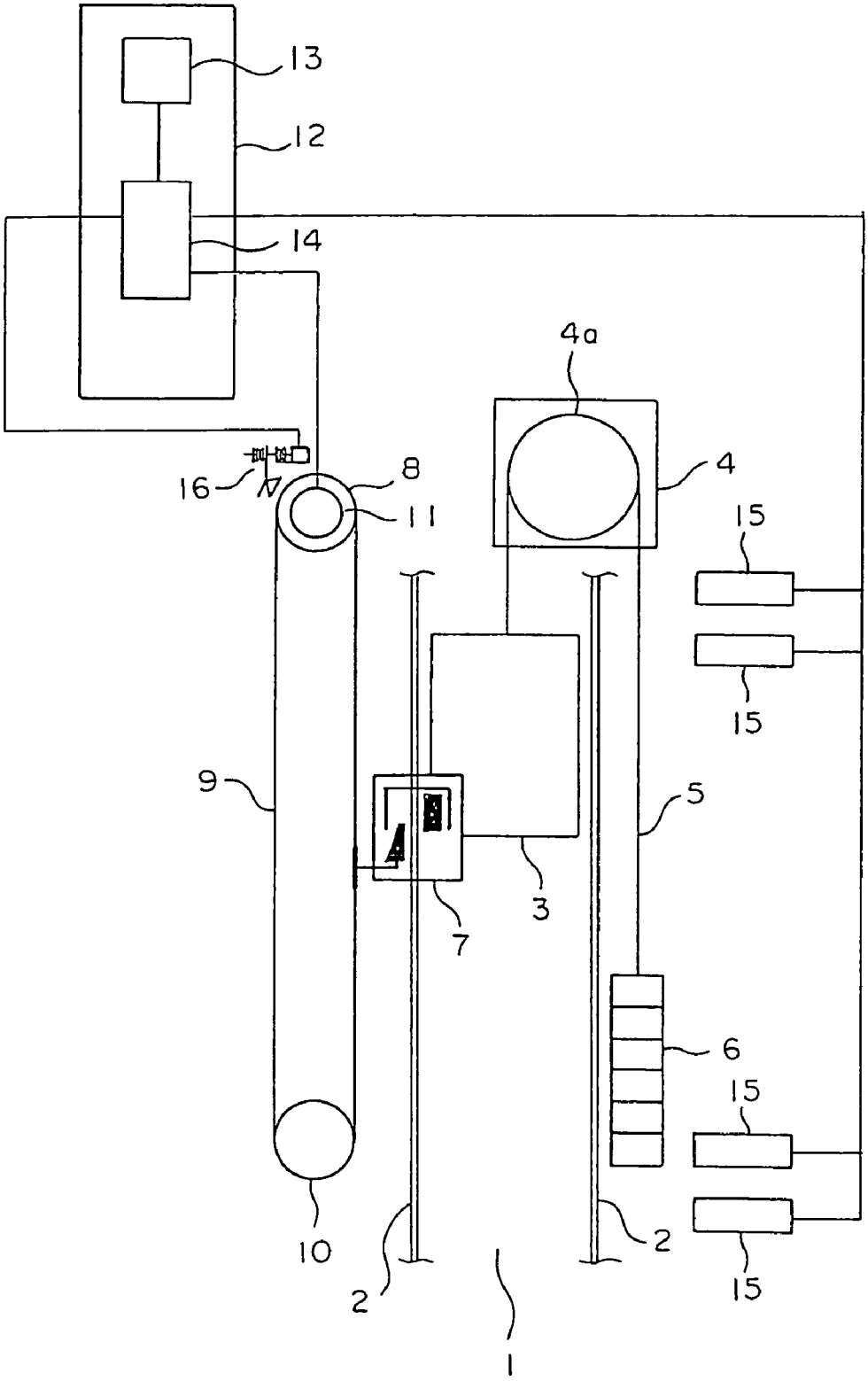
FIG. 1 is a structural view schematically showing an elevator apparatus according to Embodiment 1 of the present invention.

FIG. 1 is a structural view schematically showing an elevator apparatus according to Embodiment 1 of the present invention. Referring to FIG. 1, a pair of car guide rails 2 are provided in a hoistway 1. A car 3 is raised and lowered in the hoistway 1 while being guided by the car guide rails 2. Arranged at an upper end portion of the hoistway 1 is a hoisting machine 4 that is a drive device for raising and lowering the car 3 and a counterweight 6. A main rope 5 is wound around a drive sheave 4*a* of the hoisting machine 4. The car 3 and the counterweight 6 are suspended in the hoistway 1 by the main rope 5. The hoisting machine 4 is provided with a brake device (not shown) for braking the rotation of the drive sheave 4*a*.

Mounted in the car 3 are a pair of two safety devices (braking portions) 7 operating in an interlocking relation with each other and opposed to the car guiderails 2. Each safety device 7 is arranged below the car 3. Emergency braking is applied on the car 3 upon activating each safety device 7.

Further, a rotatable governor sheave 8 is provided at an upper end portion of the hoistway 1. Wound around the governor sheave 8 is a governor rope 9 that moves in synchronism with the raising and lowering of the car 3. Either end portion of the governor rope 9 is connected to one of the safety devices 7. Provided at a lower end portion of the hoistway 1 is a tension pulley 10 around which the governor rope 9 is wound. The weight of the tension pulley 10 imparts tension to the governor rope 9.

The governor sheave 8 is provided with an encoder 11 as a detection portion for detecting the position and speed of the car 3. Further, in the hoistway 1, there is provided an emergency stop system control device 12 (hereinafter simply referred to as the "control device 12") that is a control portion for controlling the operation of the emergency stop system. The encoder 11 is electrically connected to the control device 12. In the control device 12, the position and speed of the car 3 are obtained based on a measurement signal from the encoder 11.

In this example, in the control device 12, the position of the car 3 is obtained based on the measurement signal from the encoder 11, and the speed of the car 3 is obtained by differentiation of the position of the car 3. The control device 12 outputs an activation signal that is an electrical signal when the speed of the car 3 becomes abnormal.

The control device 12 has a storage portion (memory) 13 in which car speed abnormality determination references (set data) serving as the references in detecting the presence/absence of an abnormality in the speed of the car 3 are stored in advance, and a computing portion (CPU) 14 that detects the presence/absence of an abnormality in the speed of the car 3 based on information from each of the encoder 11 and the storage portion 13.

In the hoistway 1, a plurality of reference position sensors (reference position detecting portions) 15 are provided while being spaced from one another in the direction in which the car 3 is raised and lowered. For example, a microswitch, an induction plate, or the like can be used as each reference position sensor 15. Upon detecting the car 3, each reference position sensor 15 outputs a detection signal to the computing portion 14. In the computing portion 14, a reference position that serves as a reference in measuring the position of the car 3 is obtained through the input of the detection signal. In this example, the position of the reference position sensor 15 that has detected the car 3 is taken as the reference position. In the computing portion 14, the distance from the reference position is obtained based on information from the encoder 11, thus calculating the position of the car 3.

Provided in the vicinity of the governor sheave 8 is a rope catching device (rope restraining device) 16 for restraining the governor rope 9. The rope catching device 16 is activated upon input of an activation signal from the control device 12. The governor rope 9 is restrained upon activating the rope catching device 16.

Figure 2:
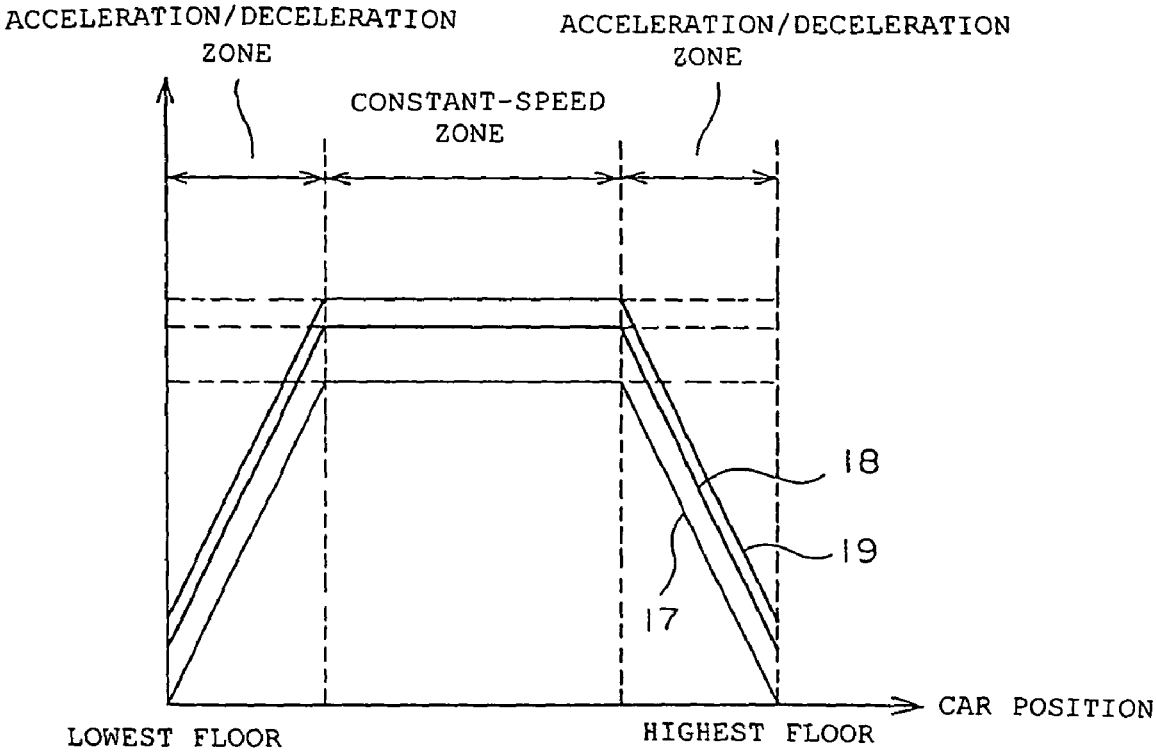
FIG. 2 is a graph showing the car speed abnormality determination references stored in the storage portion of FIG. 1.

FIG. 2 is a graph showing the car speed abnormality determination references stored in the storage portion 13 of FIG. 1. Referring to FIG. 2, in the hoistway 1, there is provided a hoisting zone in which the car 3 is raised and lowered between one service floor (stopping position) and the other service floor (stopping position). In this example, the one service floor is set as the highest floor, and the other service floor is set as the lowest floor. Within the hoisting zone, there are provided acceleration/deceleration zones adjoining the one and the other service floors and in which the car 3 is accelerated/decelerated during normal operation, and a constant-speed zone located between the two acceleration/deceleration zones and in which the car 3 is moved at a constant speed (rated speed). It should be noted that, in this example, the reference position sensors 15 (FIG. 1) are arranged in the acceleration/deceleration zones.

As the car speed abnormality determination references, three setting levels for determining the abnormality level of the speed of the car 3 are set in correspondence with the position of the car 3. That is, as the car speed abnormality determination references, a normal speed setting level (normal speed pattern) 17 as the speed of the car 3 during normal operation, a first overspeed setting level (first overspeed pattern) 18 lager in value than the normal speed setting level 17, and a second overspeed setting level (second over speed pattern) 19 larger in value than the first overspeed setting level 18, are each set in correspondence with the position of the car 3.

The normal speed setting level 17, the first overspeed setting level 18, and the second overspeed setting level 19 are each set such that its value is constant in the constant-speed zone and becomes progressively smaller toward the one and the other service floors in the acceleration/deceleration zones. Further, the first overspeed setting level 18 and the second overspeed setting level 19 are set such that they are smaller in value than the rated speed of the car 3 on the sides closer to the service floors in the acceleration/deceleration zones. Further, the difference between the first overspeed setting level 18 and the normal speed setting level 17, and the difference between the second overspeed setting level 19 and the first overspeed setting level 18 are each set to be substantially constant at all positions in the hoisting zone.

That is, in the storage portion 13, the normal speed setting level 17, the first overspeed setting level 18, and the second overspeed setting level 19 are stored as the car speed abnormality determination references in correspondence with the position of the car 3. While in this embodiment the highest and lowest floors are set as the service floors and the storage portion 13 may remain at the same overspeed setting at all times, the service floor may be changed each time the elevator travels, in which case the storage portion 13 computes the relationship between the car position and the car speed each time the elevator travels, thus setting the overspeed setting level with respect to the speed thus obtained.

When the speed of the car 3 thus obtained exceeds the first overspeed setting level 18, the computing portion 14 outputs an activation signal to the brake device of the hoisting machine 4; when the speed of the car 3 exceeds the second overspeed setting level 19, the computing portion 14 outputs activation signals to the brake device of the hoisting machine 4 and to the rope catching device 16. It should be noted that when the rope catching device 16 is to be deactivated and returned to the normal state, the computing portion 14 outputs to the rope catching device 16 a return signal that is an electrical signal. Electric power stored in the condenser is used for the activation signal and the return signal.

Figure 3:
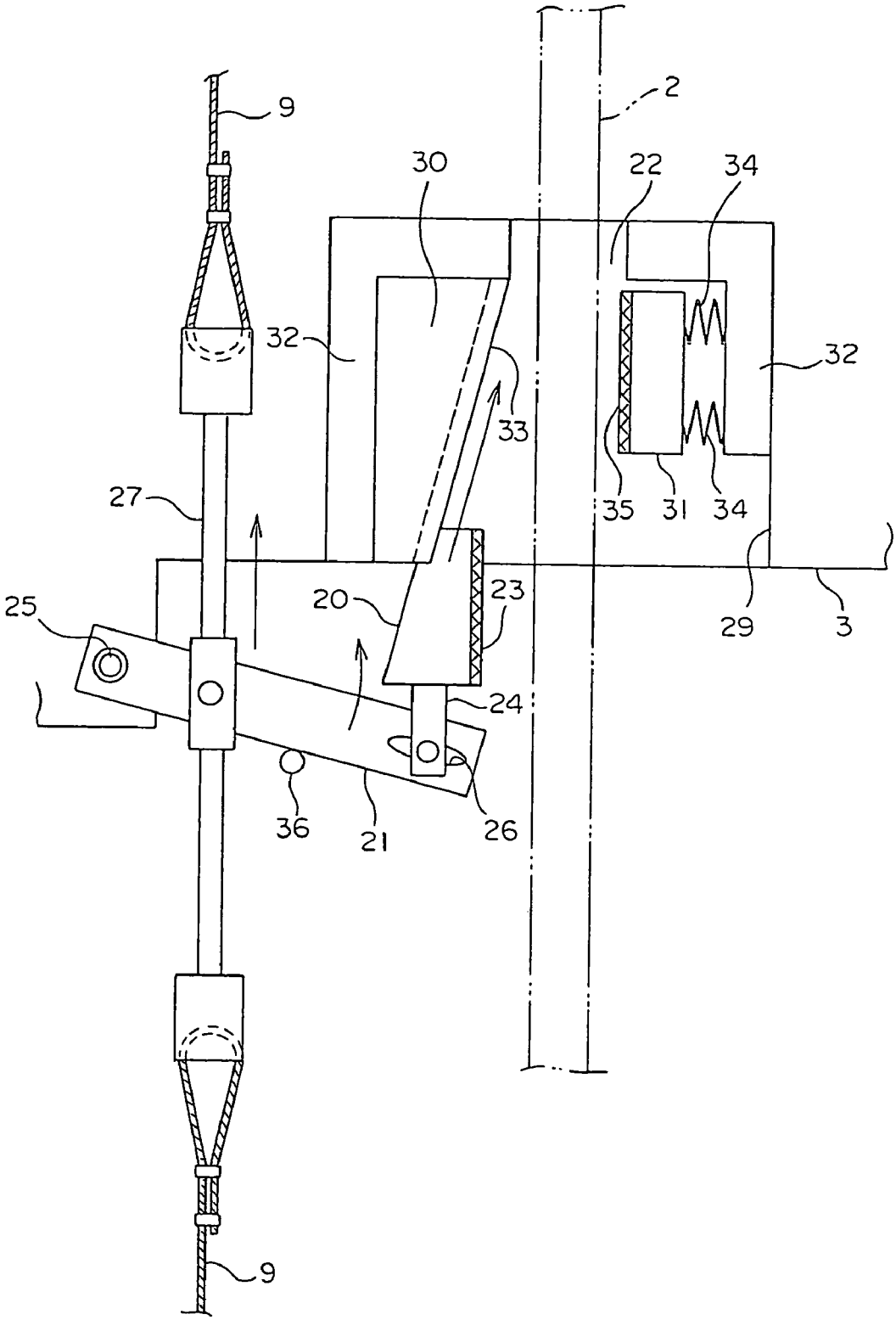
FIG. 3 is a front view showing the safety device of FIG. 1.
Figure 4:
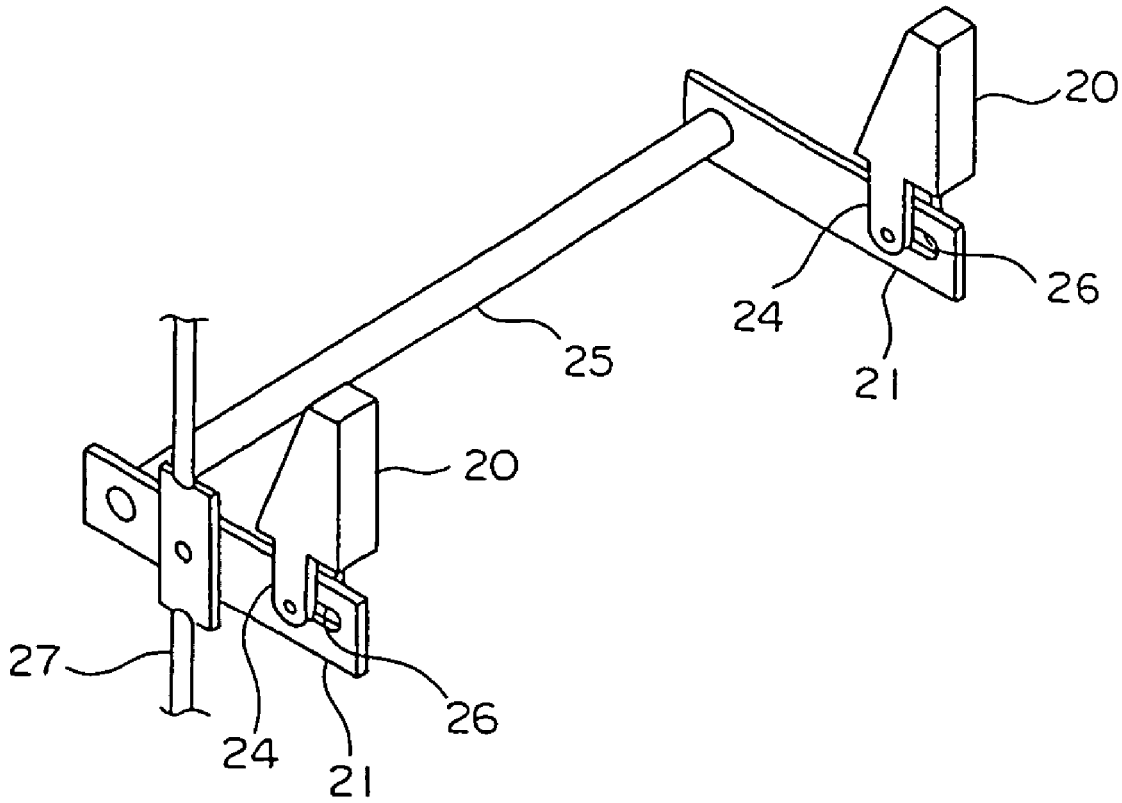
FIG. 4 is a perspective view showing the connecting portions of the safety device of FIG. 3.

FIG. 3 is a front view showing the safety device 7 of FIG. 1. Further, FIG. 4 is a perspective view showing the connecting portions of the safety device 7 of FIG. 3. Referring to the figures, each safety device 7 has: a wedge 20 as a braking member that can be brought into and out of contact with the car guide rail 2; a pivot lever 21 as a link mechanism for displacing the wedge 20 relative to the car 3 through displacement of the car 3 relative to the governor rope 9; and a jaw 22 as a guide portion for guiding the wedge 20, which is displaced by the pivot lever 21, into contact with the car guide rail 2.

Each wedge 20 is arranged below the jaw 22. Each wedge 20 is affixed with a friction material 23 that contacts the car guide rail 2. Fixed to the lower end portion of each wedge 20 is amounting portion 24 that extends downwards from the wedge 20.

A horizontally extending connecting shaft 25 is rotatably provided to the lower end portion of the car 3. One end of each pivot lever 21 is fixed to either end of the connecting shaft 25 (FIG. 4). Provided at the other end portion of each pivot lever 21 is a slot 26 extending in the longitudinal direction of the pivot lever 21. Each pivot lever 21 is provided to the lower end portion of the car 3 such that the slot 26 is arranged below the jaw 22. Each mounting portion 24 is slidably fitted in each elongate hole 26.

An operating bar 27, to which the both ends of the governor rope 9 are connected, is pivotably connected to one of the pivot levers 21 (FIGS. 3, 4). The operating bar 27 extends in the vertical direction. As the operating bar 27 is displaced with respect to the car 3, each pivot lever 21 is pivoted about the axis of the connecting shaft 25. Each wedge 20 is displaced toward the jaw 22 as the other end portion of the pivot lever 21 is pivoted upwards.

The jaw 22 is arranged in a recess 29 provided at the lower end portion of the car 3. Further, the jaw 22 has a sliding member 30 and a pressing member 31 that are arranged so as to sandwich the car guide rail 2 therebetween. The sliding member 30 and the pressing member 31 are supported by a support member 32 fixed in the recess 29.

The sliding member 30 is provided with an inclined portion 33 that slidably holds the wedge 20. The inclined portion 33 is inclined with respect to the car guide rail 2 such that its distance to the car guide rail 2 becomes smaller toward its upper portion. It should be noted that the sliding member 30 is fixed to the support member 32.

The pressing member 31 is supported on the support member 32 through support springs 34 as elastic members. The pressing member 31 is affixed with a friction material 35 that contacts the car guide rail 2.

As it is slid upwards along the inclined portion 33, the wedge 20 is displaced into contact with the car guide rail 2 and pushed in between the car guide rail 2 and the sliding member 30. The car 3 is displaced to the left as seen in the figure as the wedge 20 is pushed in between the car guide rail 2 and the sliding member 30. As a result, the wedge 20 and the pressing member 31 are displaced toward each other so as to hold the car guide rail 2 therebetween. A braking force acting on the car 3 is generated as the wedge 20 and the pressing member 31 are pressed against the car guide rail 2.

It should be noted that at the lower end portion of the car 3, there is provided a torsion spring (not shown) urging the connecting shaft 25 so as to displace each wedge 20 downwards. The malfunction of each safety device 7 is thus prevented. Further, fixed to the lower end portion of the car 3 is a stopper 36 that restricts the downward pivotal movement of the pivot lever 21. This prevents inadvertent detachment of the wedge 20 from the inclined portion 33.

Figure 5:
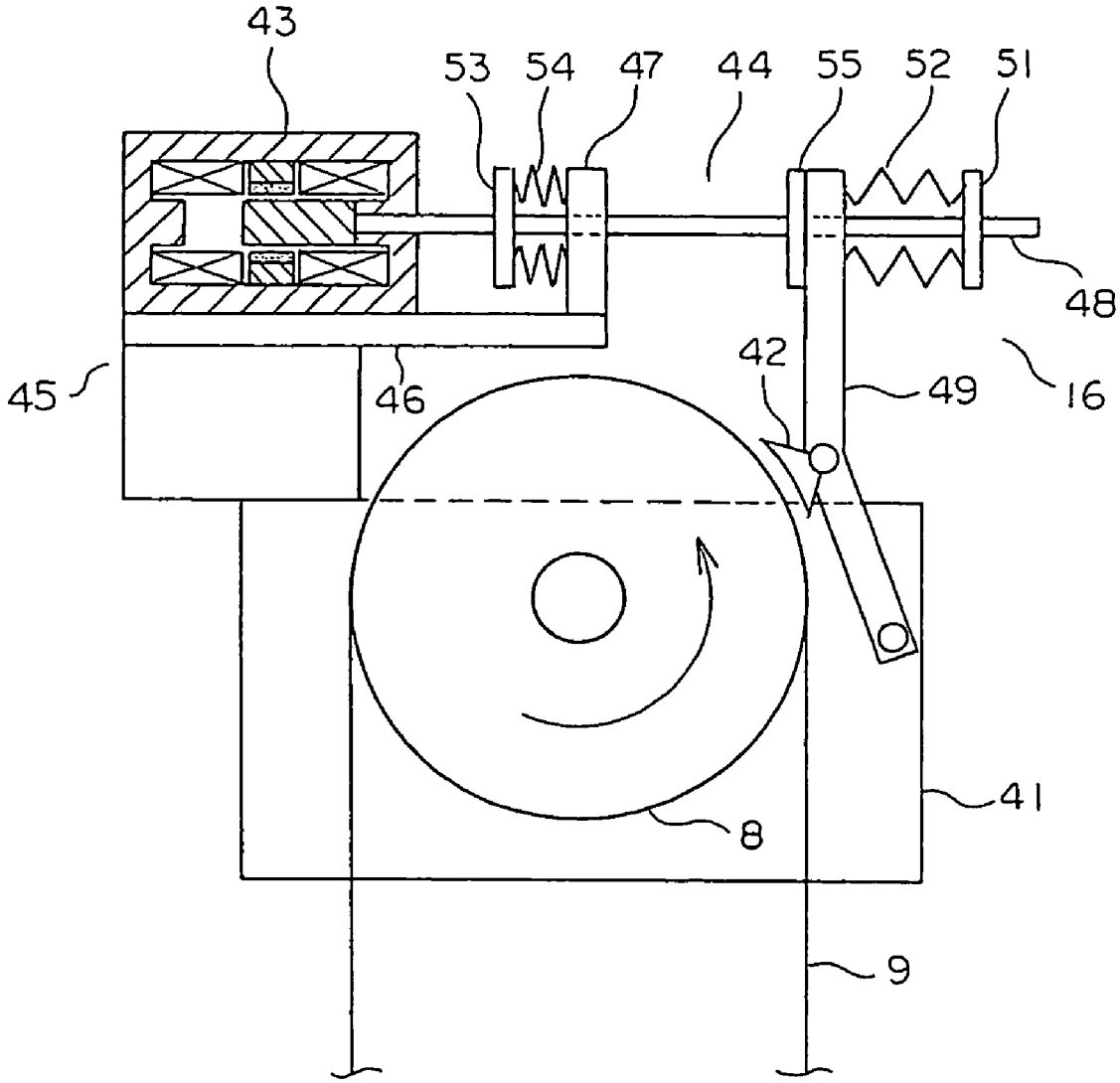
FIG. 5 is a structural view showing the rope catching device of FIG. 1.

FIG. 5 is a structural view showing the rope catching device 16 of FIG. 1. Referring to the figure, the rope catching device 16 is supported on a frame member 41 to which the governor sheave 8 is provided. Further, the rope catching device 16 has: a pressing shoe 42 that is a restraining portion displaceable between a restraining position for restraining the governor rope 9 in place and a disengaged position for releasing the restraining of the governor rope 9; an electromagnetic actuator 43 that generates a drive force for displacing the pressing shoe 42 between the restraining position and the disengaged position; and a connecting mechanism portion 44 that connects between the electromagnetic actuator 43 and the pressing shoe 42 and transmits the drive force from the electromagnetic actuator 43 to the pressing shoe 42.

Fixed on top of the frame member 41 is a mounting member 45 to which the electromagnetic actuator 43 is mounted. The mounting member 45 has a horizontal portion 46 on which the electromagnetic actuator 43 is placed, and a vertical portion 47 extending upwards from an end portion of the horizontal portion 46.

The pressing shoe 42 is formed of a friction material having a contact surface opposed to the outer periphery of the governor sheave 8. Further, when in the restraining position, the pressing shoe 42 is pressed against the governor sheave 8 through the governor rope 9, and when in the disengaged position, the pressing shoe 42 is moved away from the governor rope 9.

The electromagnetic actuator 43 is activated upon input of the activation signal from the control device 12 and displaces the pressing shoe 42 into the restraining position. Further, the electromagnetic actuator 43 is returned into position upon input of the return signal from the control device 12, whereby the pressing shoe 42 is displaced into the disengaged position.

The connecting mechanism portion 44 has a movable rod 48 that is caused to reciprocate through the drive of the electromagnetic actuator 43, and a displacement lever 49 provided with the pressing shoe 42 and causing the pressing shoe 42 to displace between the restraining position and the disengaged position due to the reciprocating motion of the movable rod 48.

One end portion (lower end portion) of the displacement lever 49 is pivotably attached to the frame member 41, and the other end portion (upper end portion) of the displacement lever 49 is slidably attached to the movable rod 48. Further, the pressing shoe 42 is pivotably attached to the intermediate portion of the displacement lever 49. As the movable rod 48 advances, the displacement lever 49 is pivoted so as to displace the pressing shoe 42 into the disengaged position, and as the movable rod 48 retracts, the displacement lever 49 is pivoted so as to displace the pressing shoe 42 into the restraining position.

The movable rod 48 extends horizontally from the electromagnetic actuator 43 and slidably penetrates the vertical portion 47. Further, a first spring connecting portion 51 is fixed to the distal end portion of the movable rod 48. Connected between the upper end portion of the displacement lever 49 and the first spring connecting portion 51 is a compression spring 52 serving as an elastic member for pressing the pressing shoe 42 onto the governor sheave 8 side when the pressing shoe 42 is in the restraining position.

A second spring connecting portion 53 is fixed between the electromagnetic actuator 43 of the movable rod 48 and the vertical portion 47. Connected between the vertical portion 47 and the second spring connecting portion 53 is an adjusting spring 54 serving as an elastic member for mitigating the load on the electromagnetic actuator 43. The adjusting spring 54 is adjusted to urge the movable rod 48 being reciprocated in the direction opposite to the direction of the urging by the compression spring 52. This prevents a large difference from developing between the magnitude of the load on the electromagnetic actuator 43 when the pressing shoe 42 is in the restraining position and the magnitude of the load on the electromagnetic actuator 43 when the pressing shoe 42 is in the disengaged position.

Fixed between the upper end portion of the displacement lever 49 of the movable rod 48 and the vertical portion 47 is a stopper 55 for restricting the range within which the upper end portion of the displacement lever 49 is allowed to slide. As the movable rod 48 advances, the stopper 55 causes the displacement lever 49 to pivot so as to displace the pressing shoe 42 into the disengaged position, while pressing on the other end portion of the displacement lever 49.

Figure 6:
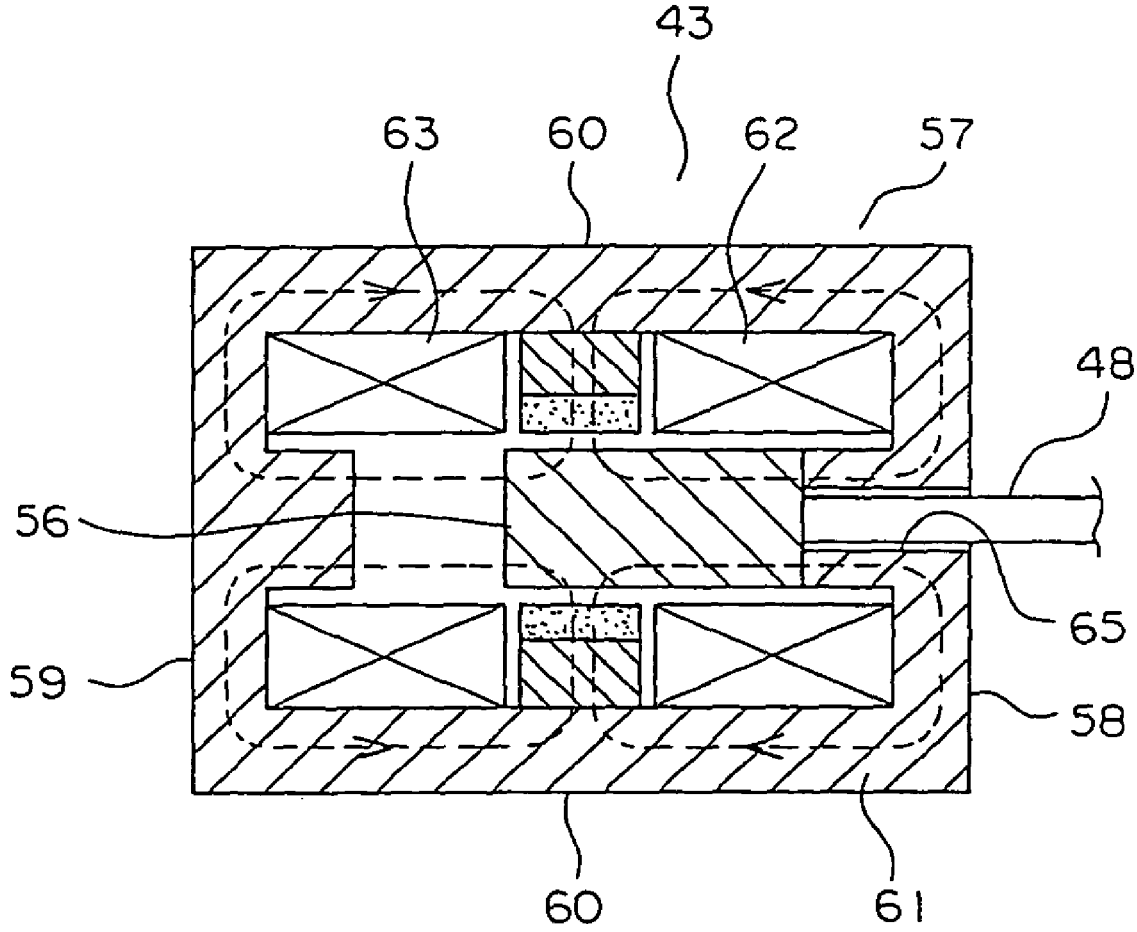
FIG. 6 is a sectional view showing the electromagnetic actuator of FIG. 5.

FIG. 6 is a sectional view showing the electromagnetic actuator 43 of FIG. 5. Referring to the figure, the electromagnetic actuator 43 has a movable iron core (movable portion) 56 fixed to the rear end portion of the movable rod 48, and a driver portion 57 for displacing the movable iron core 56.

The iron core 56 is displaceable between an activation position where the pressing shoe 42 restrains the governor rope 9 in the restraining position, and a release position where the pressing shoe 42 is displaced into the disengaged position to release the restraining of the governor rope 9.

The driver portion 57 has: a stationary iron core 61 including a pair of restricting portions 58, 59 restricting the displacement of the movable iron core 56, and a side wall portion 60 connecting the restricting portions 58, 59 to each other; a first coil 62 accommodated in the stationary iron core 61 and serving as a release coil which, when energized, displaces the movable iron core 56 into contact with one restricting portion, the restricting portion 58; a second coil 63 accommodated in the stationary iron core 61 and serving as an activation coil which, when energized, displaces the movable iron core 56 into contact with the other restricting portion, the restricting portion 59; and an annular permanent magnet 64 arranged between the first coil 62 and the second coil 63.

The one restricting portion 58 is provided with a through-hole 65 through which the movable rod 48 is passed. When in the release position, the movable iron core 56 is in abutment with the one restricting portion 58, and when in the release position, the movable iron core 56 is in abutment with the other restricting portion 59.

The first coil 62 and the second coil 63 are annular electromagnetic coils surrounding the movable iron core 56. Further, the first coil 62 is arranged between the permanent magnet 64 and the one restricting portion 58, and the second coil 63 is arranged between the permanent magnet 64 and the other restricting portion 59.

With the movable iron core 56 abutting the one restricting portion 58, a space acting as a magnetic resistance is present between the movable iron core 56 and the other restricting portion 59, so the amount of magnetic flux from the permanent magnet 64 becomes larger on the first coil 62 side than on the second coil 63 side, whereby the iron core 56 is retained in abutment with the one restricting portion 58.

Further, with the movable iron core 56 abutting the other restricting portion 59, a space acting as a magnetic resistance is present between the movable iron core 56 and the one restricting portion 58, so the amount of magnetic flux from the permanent magnet 64 becomes larger on the second coil 63 side than on the first coil 62 side, whereby the iron core 56 is retained in abutment with the other restricting portion 59.

The second coil 63 is inputted with an activation signal from the computing portion 14 (FIG. 1). When inputted with the activation signal, the second coil 63 generates a magnetic flux that acts against the force for retaining the abutment of the movable iron core 56 against the one restricting portion 58. Further, the first coil 62 is inputted with a return signal from the computing portion 14. When inputted with the return signal, the first coil 62 generates a magnetic flux that acts against the force for retaining the abutment of the movable iron core 56 against the other restricting portion 59.

Next, operation will be described. During the normal operation, the pressing shoe 42 is displaced into the disengaged position as the movable rod 48 advances (FIG. 5). Further, the wedge 20 of each safety device 7 is moved away from the car guide rail 2 (FIG. 3).

When the speed of the car 3 abnormally increases and exceeds the first overspeed setting level 18 (FIG. 2), an activation signal is outputted from the control device 12 to the brake device of the hoisting machine 4, thus activating the brake device. Braking is thus applied to the drive sheave 4*a* to brake the car 3.

When, even after the brake device of the hoisting machine 4 has been activated, the speed of the car 3 keeps rising due to, for example, a break in the main rope 5 and exceeds the second overspeed setting level 19 (FIG. 2), an activation signal is outputted to the rope catching device 16 from the control device 12. That is, the electric power stored in the condenser is instantaneously outputted from the computation portion 14 to the second coil 63 in the form of an activation signal. As a result, the movable rod 48 is retracted, whereby the displacement lever 49 is pivoted counterclockwise as seen in FIG. 5. The pressing shoe 42 is thus pressed against the governor sheave 8 through the governor rope 9 and displaced into the restraining position. As a result, the governor rope is restrained by the rope catching device 16. In the state where the pressing shoe 42 has been displaced into the restraining position, the movable iron core 56 is retained in abutment with the other restricting portion 59.

Due to the restraining of the governor rope 9 by the rope catching device 16, the governor rope 9 is displaced upwards relative to the car 3 that is descending at an abnormal speed, whereby the wedge 20 is displaced toward the jaw 22, that is, in the upward direction. At this time, the wedge 20 is displaced into contact with the car guide rail 2 while being slid on the inclined portion 33. Then, the wedge 20 and the pressing member 31 are brought into contact with and pressed against the car guide rail 2. Upon contacting the car guide rail 2, the wedge 20 is displaced further upwards to be wedged between the car guide rail 2 and the sliding member 30. As a result, a large friction force is generated between each of the wedge 20 and pressing member 31 and the car guide rail 2, thereby braking the car 3.

When releasing the braking on the car 3, the car 3 is raised and then a return signal is outputted from the control device 12 to the rope catching device 16. That is, the electric power stored in the condenser is instantaneously outputted to the first coil 62 from the computing portion 14 in the form of a return signal. The movable rod 48 is thus advanced. Then, the displacement lever 49 is abutted against the stopper 55 to be rotated clockwise as seen in FIG. 5. The pressing shoe 42 is thus displaced into the disengaged position and the restraining of the governor rope 9 is released.

In the emergency stop system for an elevator as described above, the activation signal is outputted from the control device 12 to the electromagnetic actuator 43 when the second overspeed setting level 19 set in correspondence with the position of the car 3 is exceeded. As the actuator 43 is activated upon the inputting of the activation signal, the pressing shoe 42 of the rope catching device 16 restrains the governor rope 9. Accordingly, when, for example, a performance test or the like is to be conducted on the emergency stop system, by stopping the car 3, a performance test can be carried out on the rope catching device 16, which is required to provide high reliability, without bringing the wedge 20 into contact with the car guide rail 2. The wear, damage, or the like of the car guide rail 2 and of the wedge 20 due to a performance test or the like can be thus reduced, thereby achieving extended life of the emergency stop system for an elevator.

Further, the rope catching device 16 is formed separately from the safety device 7, whereby the rope catching device 16 can be disposed in the vicinity of the governor sheave 8, facilitating maintenance and inspection operation or the like by the operator.

Further, in the hoistway 1, there are provided the acceleration/deceleration zones which adjoin the service floors for the car 3 and in which the car 3 undergoes acceleration/deceleration during the normal operation, and in each acceleration/deceleration zone, the second overspeed setting level is set to become progressively smaller toward the service floor. Accordingly, in the vicinity of the service floors for the car 3, a speed abnormality can be detected while the speed of the car 3 is still relatively low, thereby making it possible to mitigate the impact on the car 3 upon emergency stop. Further, it is also possible to reduce the braking distance for the car 3, thereby reducing the requisite length of the hoistway 1 in the height direction.

Further, in the acceleration/deceleration zones, there are provided the reference position sensors 15 that detect the reference position in detecting the position of the car 3, whereby the position of the car 3 in the acceleration/deceleration zones can be detected with greater accuracy.

Further, the encoder 11 is provided to the governor sheave 8, whereby the position and speed of the car 3 can be easily detected with the simple structure.

Further, the electromagnetic actuator 43 has: the movable iron core 56 capable of being reciprocated and displaced between the activation position and the release position; the second coil 63 that causes the movable iron core 56 to displace into the activation position when energized; the first coil 62 that causes the movable iron core 56 to displace into the release position when energized; and the permanent magnet 64 for selectively retaining the movable iron core 56 in the activation position and in the release position. Therefore, the movable iron core 56 can be displaced more reliably between the activation position and the release position. Further, the above retention involves no power consumption, thus achieving power saving.

Further, the pressing shoe 42 is pressed against the governor sheave 8 through the governor rope 9 upon the activation of the electromagnetic actuator 43, whereby the number of parts of the rope catching device 16 can be reduced to achieve a reduction in cost. Further, the installation of the rope catching device 16 can be facilitated as well.

Embodiment 2

Figure 7:
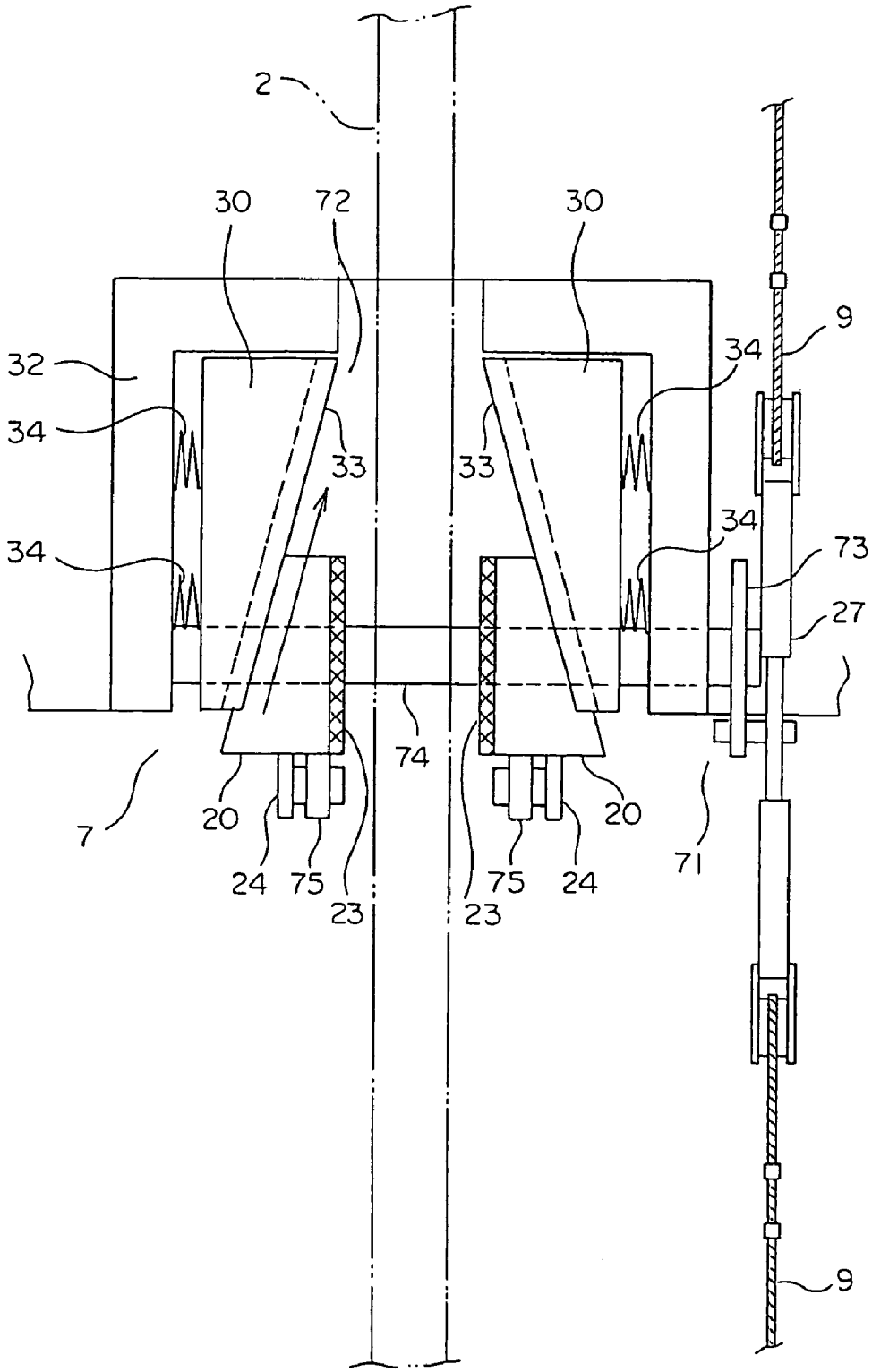
FIG. 7 is a schematic front view showing a safety device of an emergency stop system for an elevator according to Embodiment 2 of the present invention.
Figure 8:
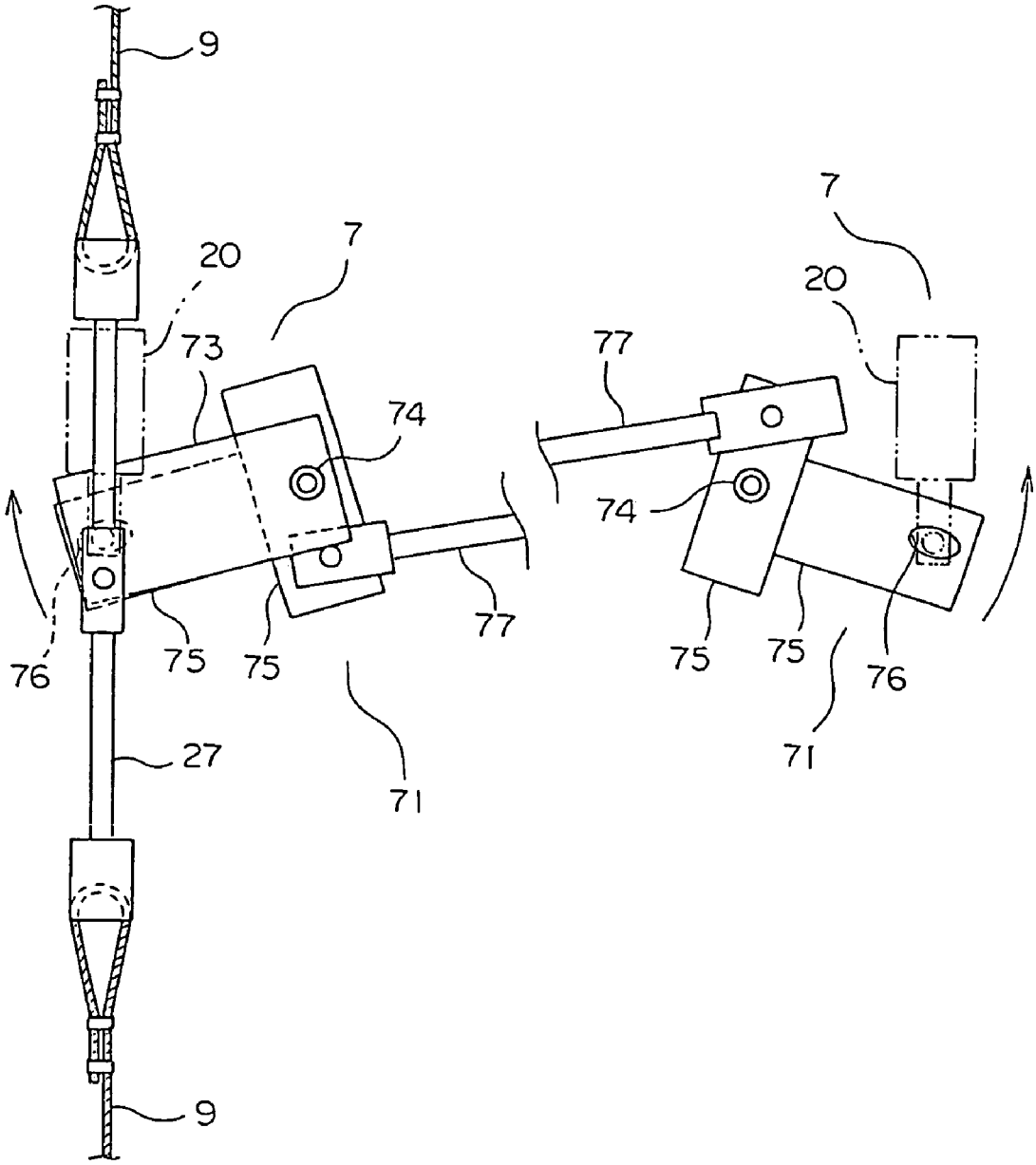
FIG. 8 is a side view showing the safety device of FIG. 7.

FIG. 7 is a schematic front view showing a safety device of an emergency stop system for an elevator according to Embodiment 2 of the present invention, and FIG. 8 is a side view showing the safety device of FIG. 7. While in Embodiment 1 the car guide rail 2 is pinched by the wedge 20 and the pressing member 31, as shown in FIG. 7, the car guide rail 2 may be pinched by a pair of the wedges 20.

Referring to the figure, each safety device 7 has: the pair of wedges 20; a link mechanism 71 for displacing each wedge 20 with respect to the car 3 through the restraining of the governor rope 9 while the car 3 is being lowered; and a jaw 72 as a guide portion for guiding each wedge 20, which is displaced by the link mechanism 71, into contact with the car guide rail 2.

The link mechanism 71 has: a connection plate 73 whose one end portion is pivotably connected to the operating bar 27; a horizontal shaft 74 fixed to the other end portion of the connection plate 73 and extending horizontally; and a pair of wedge mounting members 75 fixed to the horizontal shaft 74 and to each of which each wedge 20 is provided. A mounting portion 24 for mounting the wedge 20 to the wedge mounting member 75 is fixed to the lower end portion of each wedge 20.

The horizontal shaft 74 is provided to the car 3. Further, the horizontal shaft 74 is rotatable about the axis of the horizontal shaft 74. One end portion of each wedge mounting member 75 is fixed to the horizontal shaft 74. Provided in the other end portion of each wedge mounting member 75 is a slot 76 in which the mounting portion 24 is slidably mounted. The mounting portion 24 is slidably fitted in the slot 76.

The respective safety devices 7 are connected to each other by an interlock member 77. The respective safety devices 7 are thus operated in an interlocking manner.

One end portion of the interlock member 77 is pivotably connected to the lower end portion of one of the wedge mounting members 75. Further, the other end portion of the interlock member 77 is pivotably connected to the upper end portion of the other wedge mounting member 75. As a result, the one and the other wedge mounting members 75 are pivoted about each horizontal shaft 74 such that the wedges 20 are displaced in the same direction with respect to the car 3 (FIG. 8).

The jaw 72 has a pair of the sliding members 30 for guiding each wedge 20. Each sliding member 30 is supported on the support member 32 through the support springs 34. As a result, a pressing force is applied to each wedge 20 as the car guide rail 2 is pinched by the wedges 20. Otherwise, Embodiment 2 is of the same construction as Embodiment 1.

Next, the operation of each safety device 7 will be described. When the rope catching device 16 is activated and the operating bar 27 is displaced upwards with respect to the car 3, the connection plate 73 and each wedge mounting member 75 are pivoted about the axis of the horizontal shaft 74. As a result, each wedge member 20 is displaced along each sliding member 30 into contact with the car guide rail 2 while being displaced upwards with respect to the car 3. Likewise, each wedge 20 of the other safety device 7 is also displaced into contact with the car guide rail 2 while being displaced upwards with respect to the car 3.

Even after making contact with the car guide rail 2, each wedge 20 is displaced further upwards with respect to the car 3 to be wedged between the car guide rail 2 and the sliding member 30. As a result, a large friction force is generated between each wedge 20 and the car guide rail 2, thereby braking the car 3.

With the above-described emergency stop system for an elevator as well, a performance test can be carried out on the rope catching device 16, which is required to provide high reliability, without bringing the wedge 20 into contact with the car guide rail 2, thereby making it possible to reduce wear, damage, or the like of the guide rail 2 and wedge 20. Therefore, the life of the emergency stop system for an elevator can be extended.

Figure 9:
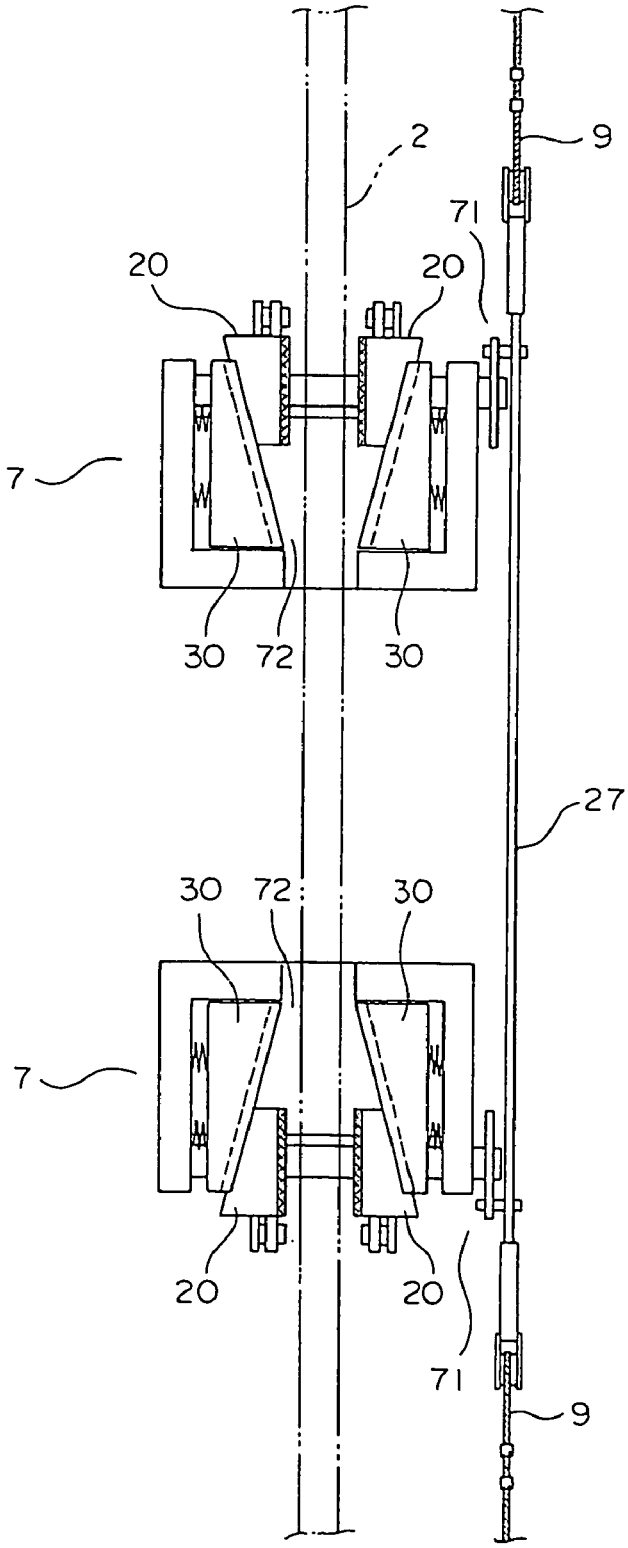
FIG. 9 is a schematic front view showing another example according to Embodiment 2 of the present invention.

While in the above-described example the safety device 7 mounted in the car 3 applies braking on the downward movement of the car 3, as shown in FIG. 9, another, vertically inverted safety device 7 may be mounted in the car 3 to apply braking on the upward movement of the car 3 as well.

Embodiment 3

Figure 10:
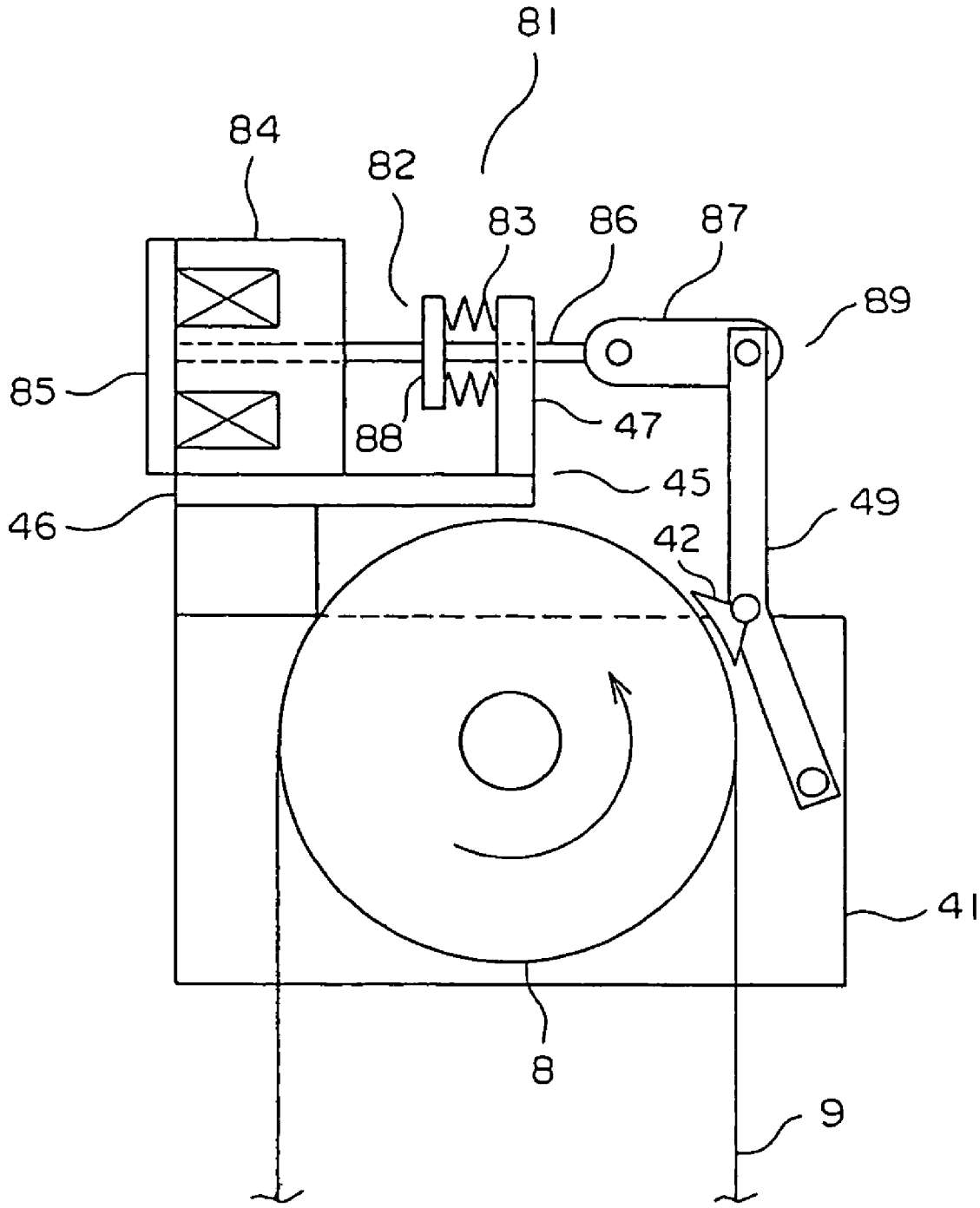
FIG. 10 is a structural view showing a rope catching device of an emergency stop system for an elevator according to Embodiment 3 of the present invention.

FIG. 10 is a structural view showing a rope catching device of an emergency stop system for an elevator according to Embodiment 3 of the present invention. Referring to the figure, an electromagnetic actuator 81 is mounted to the mounting member 45. The electromagnetic actuator 81 has: a movable portion 82 that is displaceable between an activation position for causing the pressing shoe 42 to restrain the governor rope 9 and a release position for releasing the restraining of the governor rope 9; a compression spring 83 as an urging portion for urging the movable portion 82 toward the activation position; and an electromagnet 84 for displacing the movable portion 82 toward the release position against the urging force of the compression spring 83. The electromagnet 84 is mounted on top of the horizontal portion 46.

The movable portion 82 has a movable plate 85 that is sucked onto the electromagnet 84 upon energizing the electromagnet 84, and a movable rod 86 fixed to the movable plate 85 and slidably penetrating the electromagnet 84 and the vertical portion 47.

The distal end portion of the movable rod 86 is connected to the upper end portion of the displacement lever 49 through a link 87. The link 87 is connected to each of the movable rod 86 and the displacement lever 49. A spring connecting portion 88 is fixed to the portion of the movable rod 86 between the electromagnet 84 and the vertical portion 47. The compression spring 83 is connected between the spring connecting portion 88 and the vertical portion 47.

Here, the displacement lever 49 is pivoted due to the reciprocating motion of the movable rod 86. Accordingly, the positional relation between the movable rod 86 and the displacement lever 49 varies due to a difference in displacement between the movable rod 86 and the displacement lever 49. The link 87 is connected between the movable rod 86 and the displacement lever 49 in order to permit this variation.

The electromagnetic actuator 81 is activated upon input of an activation signal from the control device 12. The electromagnetic actuator 81 is activated upon stopping the energization of the electromagnet 84. When the electromagnetic actuator 81 is activated, the movable portion 82 is retracted for displacement into the activation position. This causes the pressing shoe 42 to be displaced into the restraining position.

Further, the activation of the electromagnetic actuator 81 is released upon input of a return signal from the control device 12. The electromagnetic actuator 81 is returned into position upon energization of the electromagnet 84. As the activation of the electromagnetic actuator 81 is released, the movable portion 82 is advanced for displacement into the release position. The pressing shoe 42 is thus displaced into the disengaged position. It should be noted that a connecting mechanism portion 89 has the link 87 and the displacement lever 49. Otherwise, Embodiment 3 is of the same construction as Embodiment 1.

Next, the operation of the rope catching device will be described. During the normal operation, the return signal from the control device 12 is continuously inputted to the electromagnetic actuator 81, thereby keeping the electromagnet 84 energized. The movable portion 82 is in the release position in this state, so the restraining of the governor rope 9 by the pressing shoe 42 is released.

When the activation signal from the control device 12 is inputted to the electromagnetic actuator 81, the energization of the electromagnet 84 is stopped. As a result, the adsorption of the movable plate 85 by the electromagnet 84 is released, and the movable portion 82 is retracted and displaced into the activation position while being urged by the compression spring 83. As a result, the pressing shoe 42 is displaced into the restraining position to restrain the governor rope 9. The subsequent operations are the same as those of Embodiment 1.

For a return operation, the return signal is outputted from the control device 12 to the electromagnetic actuator 81, thereby energizing the electromagnet 84. Accordingly, the movable portion 82 is advanced, so the pressing shoe 94 is displaced into the disengaged position. As a result, the restraining of the governor rope 9 is released.

In the emergency stop system for an elevator as described above, the movable portion 82 is displaced into the activation position by the compression spring 83; when the electromagnet 84 is energized, the movable portion 82 is displaced into the release position against the urging of the compression spring 83. Accordingly, in the same manner as in the above-described embodiments, the life of the emergency stop system can be extended, and the structure of the electromagnetic actuator 81 can be simplified to achieve a reduction in cost.

Embodiment 4

Figure 11:
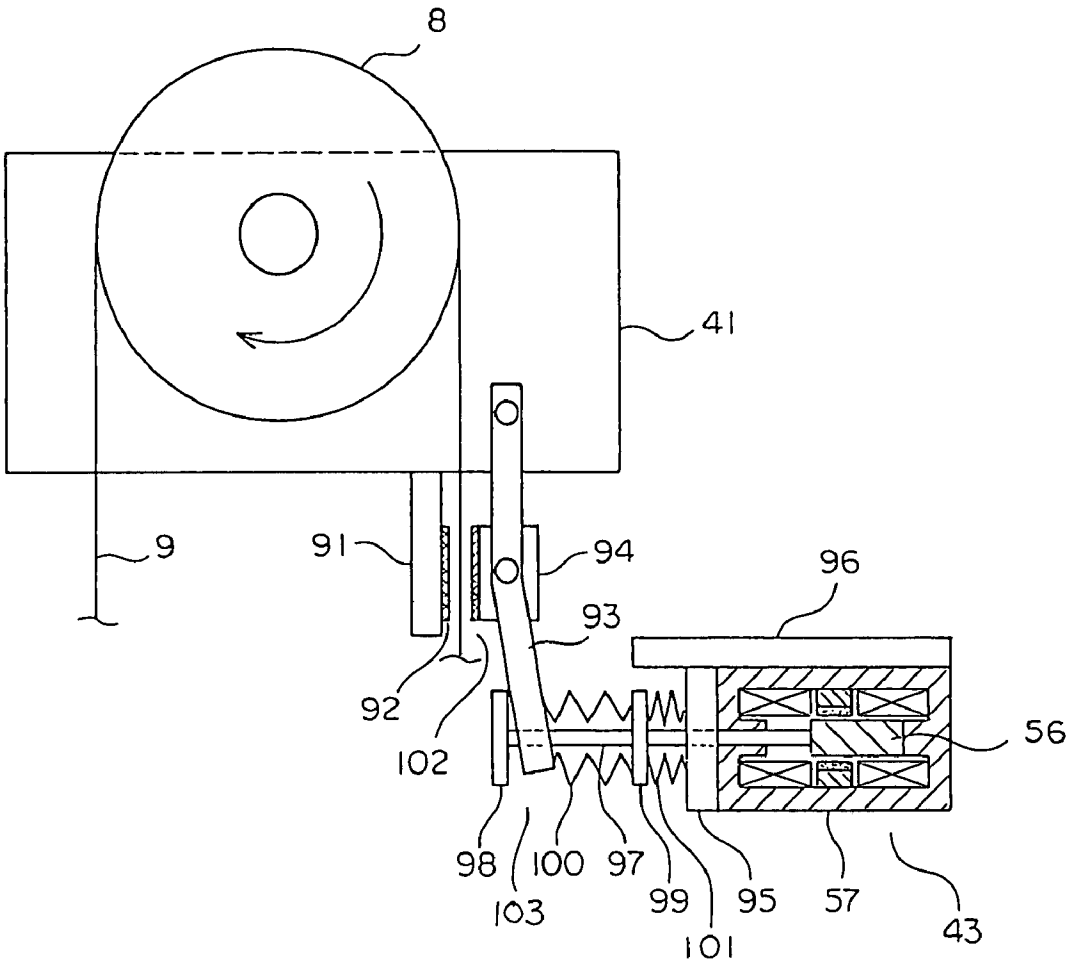
FIG. 11 is a structural view showing a rope catching device of an emergency stop system for an elevator according to Embodiment 4 of the present invention.

FIG. 11 is a structural view showing a rope catching device of an emergency stop system for an elevator according to Embodiment 4 of the present invention. Referring to the figure, fixed to the lower end portion of the frame member 41 is a fixing member 91 extending downwards from the frame member 41. A receiving portion 92 formed of a high friction material is affixed to the fixing member 91. Further, the upper end portion of a substantially obtuse V-shaped displacement lever 93 is pivotably connected to the frame member 41.

Pivotably provided to the intermediate portion of the displacement lever 93 is a pressing shoe 94 as a pressing member displaceable into and out of contact with the receiving portion 92. The pressing shoe 94 is displaceable between a restraining position, where it is pressed against the receiving portion 92 through the governor rope 9 due to the pivotal movement of the displacement lever 93, and a disengaged position where it is moved away from the governor rope 9. The portion of the pressing shoe 94 which comes into contact with the governor rope 9 is formed of a high friction material.

An actuator supporting member 96 having a projection portion 95 is fixed below the frame member 41. The electromagnetic actuator 43 of the same construction as that of Embodiment 1 is supported on the actuator supporting member 96. A movable rod 97 fixed to the movable iron core 56 extends horizontally from the electromagnetic actuator 43. The movable rod 97 slidably penetrates the projection portion 95.

The lower end portion of the displacement lever 93 is slidably provided to the movable rod 97. Further, fixed to the distal end portion of the movable rod 97 is a stopper 98 for restricting the range within which the lower end portion of the displacement lever 93 is allowed to slide. A spring connecting portion 99 is fixed to the portion of the movable rod 97 between the lower end portion of the displacement lever 93 and the projection portion 95.

Connected between the lower end portion of the displacement lever 93 and the spring connecting portion 99 is a compression spring 100 that is an elastic member for pressing the pressing shoe 94 in the restraining position onto the receiving portion 92 side. Further, connected between the projection portion 95 and the spring connecting portion 99 is an adjusting spring 101 that is an elastic member for mitigating the load on the electromagnetic actuator 43.

The electromagnetic actuator 43 is activated upon input of an activation signal from the control device 12. The movable rod 97 is advanced through the activation of the electromagnetic actuator 43 to displace the pressing shoe 94 into the restraining position. Further, the movable rod 97 is retracted upon input of a return signal to the electromagnetic actuator 43. As the movable rod 97 is retracted, the pressing shoe 94 is displaced into the disengaged position.

It should be noted that a restraining portion 102 has the receiving position 92 and the pressing shoe 94. Further, a connecting mechanism portion 103 has the movable rod 97 and the displacement lever 93. Otherwise, Embodiment 4 is of the same construction as Embodiment 1.

Next, the operation of the rope catching device will be described. During the normal operation, the movable rod 97 is retracted and the pressing shoe 94 is thus placed in the disengaged position.

When the activation signal from the control device 12 is inputted to the electromagnetic actuator 43, the displacement lever 93 is pivoted as the movable rod 97 is advanced, so the pressing shoe 94 is displaced into the restraining position. As a result, the governor rope 9 is pinched between the receiving portion 92 and the pressing shoe 94 and restrained. The subsequent operations are the same as those of Embodiment 1.

For a return operation, the return signal is outputted from the control device 12, causing the movable rod 97 to retract. Accordingly, the pressing shoe 94 is displaced into the disengaged position, whereby the restraining of the governor rope 9 is released.

In the emergency stop system for an elevator as described above, upon activating the rope catching device, the pressing shoe 94 is pressed against the receiving portion 92 formed of a high friction material through the governor rope 9, thereby achieving a further increase in the restraining force on the governor rope 9.

Embodiment 5

Figure 12:
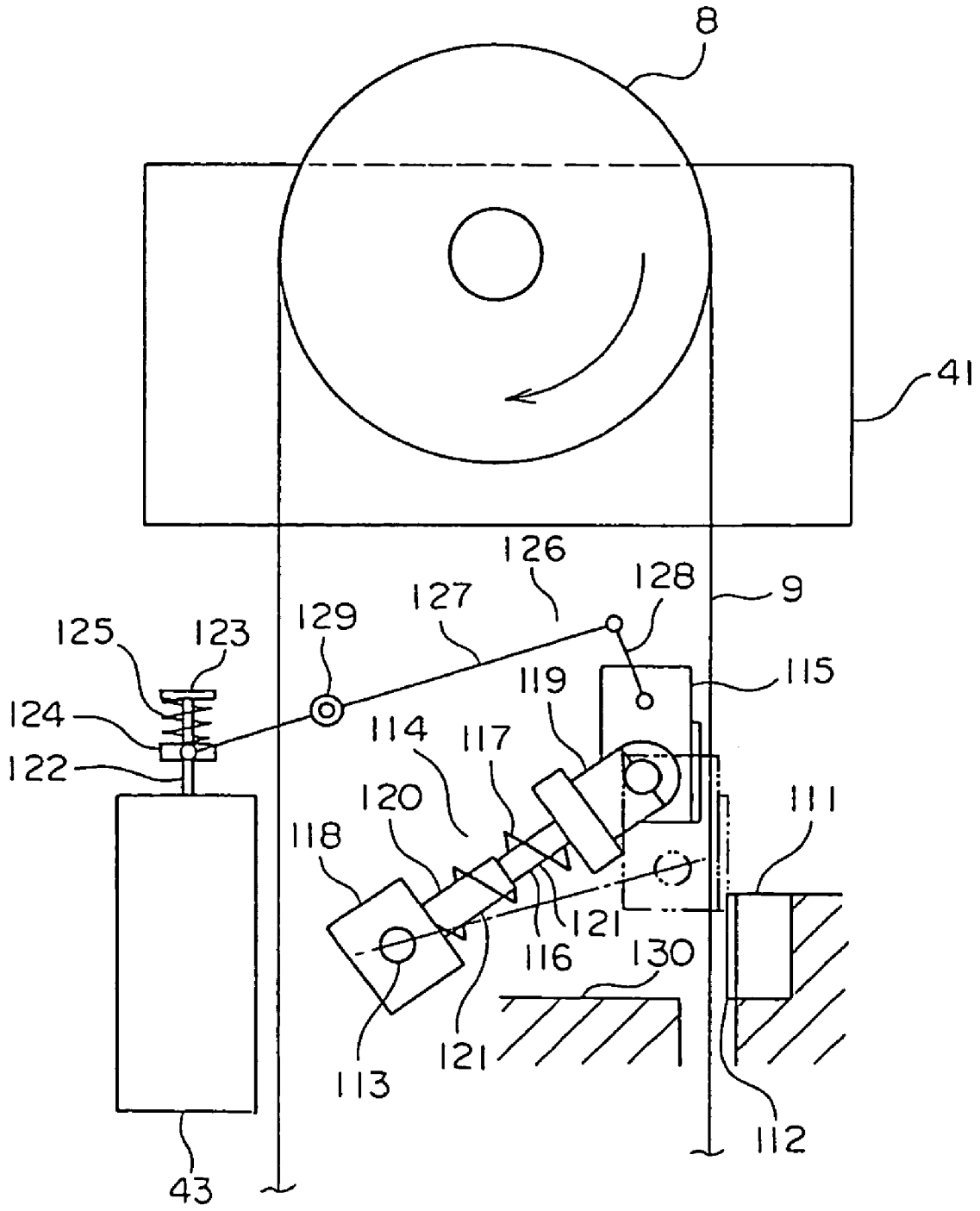
FIG. 12 is a structural view showing a rope catching device of an emergency stop system for an elevator according to Embodiment 5 of the present invention.
Figure 13:
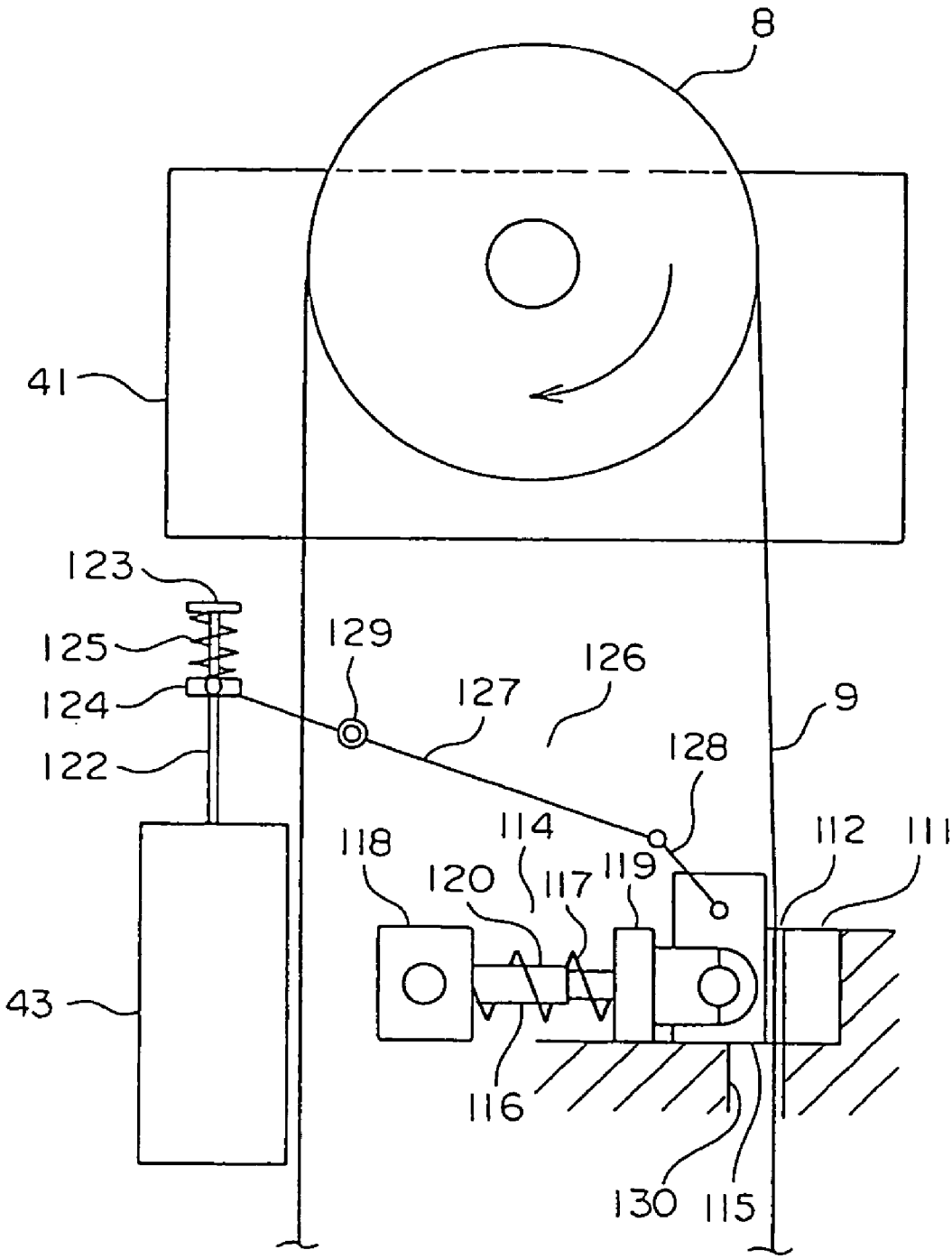
FIG. 13 is a structural view showing a state in which the rope catching device of FIG. 12 has been activated.

FIG. 12 is a structural view showing a rope catching device of an emergency stop system for an elevator according to Embodiment 5 of the present invention. Further, FIG. 13 is a structural view showing a state in which the rope catching device of FIG. 12 has been activated. Referring to the figures, a fixing member 111 is fixed in the vicinity of the governor rope 9. A receiving portion 112 formed of a high friction material is affixed to a side surface of the fixing member 111.

A horizontal shaft 113 is fixed in the hoistway 1. The horizontal shaft 113 is arranged at substantially the same height as the receiving portion 112. One end portion of an elastic expansion member 114 that is capable of expansion and contraction is pivotably provided to the horizontal shaft 113. Pivotably provided to the other end portion of the elastic expansion member 114 is a pressing shoe 115 that is displaceable into and out of contact with the receiving portion 112. As the elastic expansion member 114 pivots about the horizontal shaft 113, the pressing shoe 115 is displaced between a restraining position (FIG. 13) where the pressing shoe 115 is pressed against the receiving portion 112 through the governor rope 9, and a disengaged position (FIG. 12) where the pressing shoe 115 is moved away from the governor rope 9 to release the restraining of the governor rope 9. When the pressing shoe 115 is in the restraining position, the elastic expansion member 114 is contracted by the reaction force of the receiving portion 112.

The length of the elastic expansion member 114 is adjusted such that the pressing shoe 115 is pivoted without its lower end portion abutting the upper surface of the receiving portion 112 and that the elastic expansion member 114 undergoes contraction between the horizontal shaft 113 and the receiving portion 112 when the elastic expansion member 114 is substantially horizontal. Further, the elastic expansion member 114 has an expansion rod 116 to which the pressing shoe 115 is provided, and a compression spring 117 for urging the pressing shoe 115 that is in the restraining position onto the receiving portion 112 side.

The expansion rod 116 has a first connecting portion 118 pivotably provided to the horizontal shaft 113, a second connecting portion 119 pivotably connected to the pressing shoe 115, and an expansion portion 120 connecting between the first and second connecting portions 118, 119. The expansion portion 120 has a plurality of slide tubes 121 capable of sliding with respect to each other. Further, the expansion portion 120 can expand and contract as the slide tubes 121 are slid with respect to each other.

The compression spring 117 is connected between the first and second connecting portions 118, 119. Further, as the compressing spring 117 is displaced so as to bring the first connecting portion 118 and the second connecting portion 119 closer to each other, the compressing spring 117 generates an elastic restoration force acting in the direction in which the elastic expansion member 114 expands.

Further, the electromagnetic actuator 43 of the same construction as that of Embodiment 1 is disposed in the hoistway 1. Vertically extending from the electromagnetic actuator 43 is a movable rod 122 capable of reciprocating with respect to the electromagnetic actuator 43. A spring connecting portion 123 is fixed to the distal end portion of the movable rod 122. Further, a fastening member 124 is slidably provided to the portion of the movable rod 122 between the spring connecting portion 123 and the electromagnetic actuator 43. A connecting spring 125 is connected between the spring connecting portion 123 and the fastening member 124.

The fastening member 124 and the pressing shoe 115 are connected to each other through a connecting mechanism portion 126. The connecting mechanism portion 126 has a first link member 127 and a second link member 128 that are pivotably connected to each other.

The first link member 127 is supported on a support shaft 129 parallel to the horizontal shaft 113. The supported shaft 129 is fixed in position in the hoistway 1. The intermediate portion of the first link member 127 is pivotably provided to the support shaft 129. Further, one end portion of the first link member 127 is pivotably connected to the fastening member 124, and the other end portion of the first link member 127 is pivotably connected to one end portion of the second link member 128.

The length of the second link member 128 is smaller than the length of the first link member 127. The other end portion of the second link member 128 is pivotably connected to the pressing shoe 115.

As the movable rod 122 is displaced (advanced) upwards, the pressing shoe 115 is pivoted downwards about the horizontal shaft 113 to be displaced into the restraining position. Further, as the movable rod 122 is displaced (retracted) downwards, the pressing shoe 115 is pivoted upwards about the horizontal shaft 113 to be displaced into the disengaged position.

It should be noted that in the vicinity of the receiving portion 112, there is provided a stopper 130 for restricting the downward pivotal movement of the pressing shoe 115 to retain the pressing shoe 115 in the restraining position. Further, as the pressing shoe 115 contacts the governor rope 9 while the car 3 is lowered, the pressing shoe 115 is pivoted so as to be pressed onto the receiving portion 112 side. Otherwise, Embodiment 5 is of the same construction as Embodiment 1.

Next, the operation of the rope catching device will be described. During the normal operation, the movable rod 122 is retracted downwards and thus the pressing shoe 115 is placed in the disengaged position (FIG. 12).

When the activation signal from the control device 12 is inputted to the electromagnetic actuator 43, the movable rod 122 is advanced upwards, and the pressing shoe 115 is pivoted downwards about the horizontal shaft 113. At this time, the pressing shoe 115 presses the governor rope 9 rightwards in the figure while undergoing downward pivotal movement, thereby bringing the governor rope 9 into contact with the side surface of the receiving portion 112. Then, the pressing shoe 115 is pulled further downwards due to the movement of the governor rope 9 and the weight of the pressing shoe 115 itself. At this time, the pressing shoe 115 is displaced into the restraining position along the side surface of the receiving portion 112 while contracting the elastic expansion member 114, with the governor rope 9 being sandwiched between the pressing shoe 115 and the receiving portion 112. Accordingly, an elastic restoration force is generated in the compression spring 117, so the pressing shoe 115 presses the governor rope 9 against the receiving portion 112. As a result, the governor rope 9 is restrained (FIG. 13). The subsequent operations are the same as those of Embodiment 1.

For a return operation, the return signal is outputted from the control device 12 to cause the movable rod 122 to retract. As a result, the pressing shoe 115 is displaced into the disengaged position and thus the restraining of the governor rope 9 is released.

In the safety device for an elevator as described above, as the pressing shoe 115 is pulled while in contact with the governor rope 9, the pressing shoe 115 is displaced so as to increase the force with which the governor rope 9 is pressed against the receiving portion 112, whereby the governor rope 9 can be restrained with enhanced reliability.

While in the above-described example the restraining of the governor rope 9 is released by the electromagnetic actuator 43, another release device that generates a large drive force may be used to release the restraining of the governor rope 9. For example, a device having a ball screw or the like may be used as the release device.

Further, a wire or the like for pulling up the pressing shoe 115 may be connected to the pressing shoe 115 in advance. This allows the restraining of the governor rope 9 to be released by the operator or the like as well.

Embodiment 6

Figure 14:
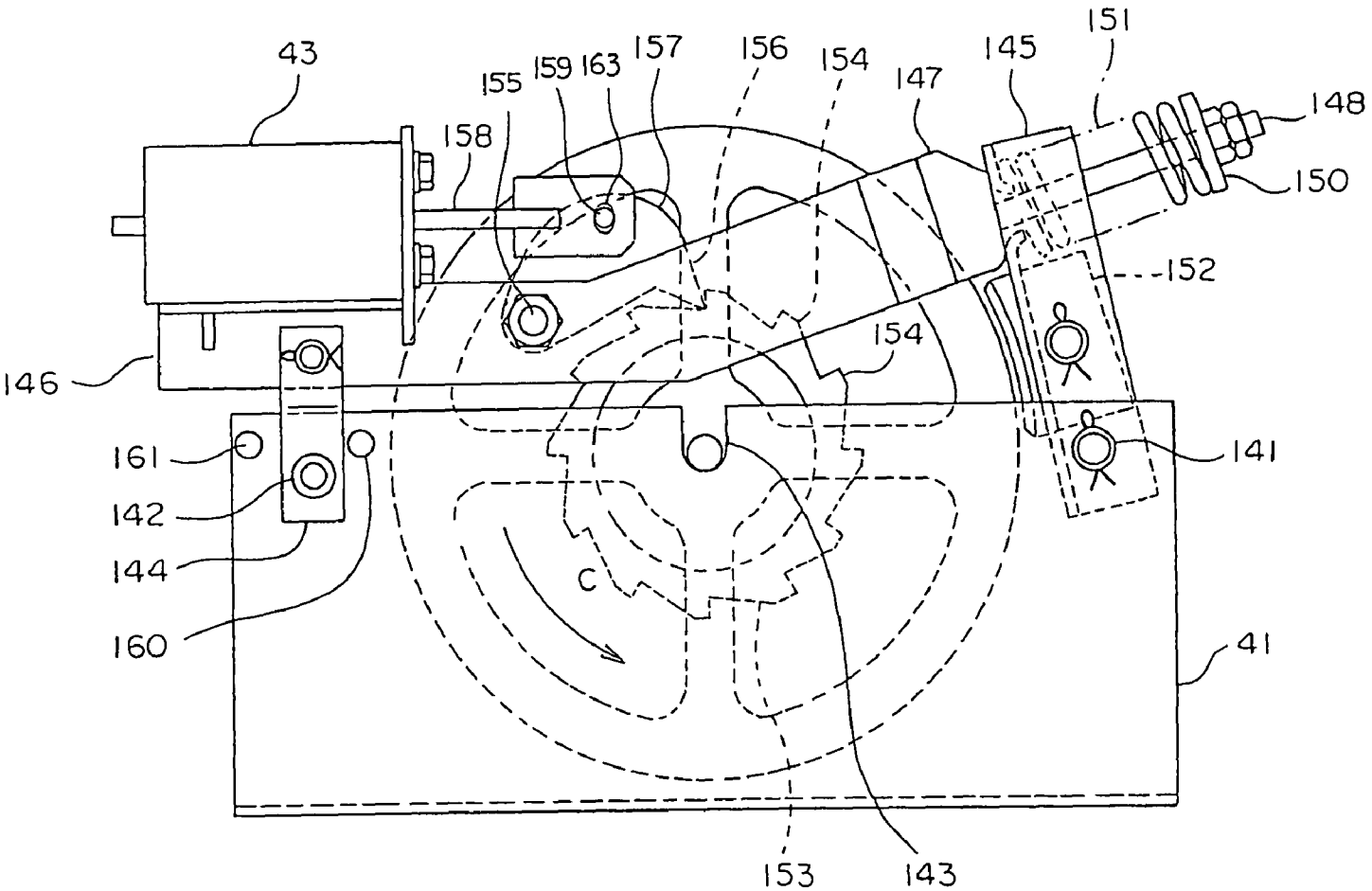
FIG. 14 is a front view showing a rope catching device of an emergency stop system for an elevator according to Embodiment 6 of the present invention.

FIG. 14 is a front view showing a rope catching device of an emergency stop system for an elevator according to Embodiment 6 of the present invention. Referring to the figure, support shafts 141, 142 are fixed to a frame member 41. A support portion 143 for the rotation shaft of the governor sheave 8 is provided to the portion of the frame member 41 between the support shaft 141 and the support shaft 142. One end portion (lower end portion) of the support link 144, and one end portion (lower end portion) of a displacement lever 145 are pivotably provided to the support shaft 141 and the support shaft 142, respectively.

Arranged above the frame member 41 is a movable base 146 displaceable with respect to the frame member 41. The movable base 146 is connected to the respective other end portions (upper end portions) of the support link 144 and displacement lever 145. The movable base 146 is thus supported on the frame member 41 through the support link 144 and the displacement lever 145.

The movable base 146 has a movable base main body 147, and a screw bar 148 extending outwards from the movable base main body 147 and slidably penetrated through the upper end portion of the displacement lever 145. The upper end portion of the support link 144 is pivotably provided to the movable base main body 147.

Mounted to the screw bar 148 is a spring fastening member 150 whose distance from the movable base main body 147 can be adjusted. A compression spring 151 as an elastic member fitted to the screw bar 148 is arranged between the upper end portion of the displacement lever 145 and the spring fastening member 150. The compression spring 151 is compressed between the upper end portion of the displacement lever 145 and the spring fastening member 150. As a result, the upper end portion of the displacement lever 145 and the spring fastening member 150 are urged so as to move away from each other.

A pressing shoe 152 as a pressing member is pivotably provided to the intermediate portion of the displacement lever 145. The pressing shoe 152 is displaceable between a restraining position where it is pressed against the governor sheave 8 through the governor rope 9, and a disengaged position where it is moved away from the governor rope 9. The pressing shoe 152 is displaced between the restraining position and the disengaged position due to the pivotal movement of the displacement lever 145 about the support shaft 141.

Fixed to the governor sheave 8 is a ratchet gear 153 rotated integrally with the governor sheave 8. The ratchet gear 153 has a plurality of tooth portions 154 in its outer peripheral portion.

A latch supporting shaft 155 is fixed to the movable base main body 147. A latch 157 having a claw portion 156 is pivotably provided to the latch supporting shaft 155. The latch 157 is displaceable between an engaged position where the claw portion 156 is engaged with the tooth portion 154 of the ratchet gear 153, and a release position where the claw portion 156 is released from engagement with the ratchet gear 153. The latch 157 is displaced between the engaged position and the release position as it pivots about the latch supporting shaft 155.

The latch supporting shaft 155 is arranged at a position lower than the height of the distal end portion of the claw portion 156 when the latch 157 is in the engaged position. Further, the cutting angle of the tooth portions 154 with respect to the rotation direction of the ratchet gear 153 is set such that the trajectory of the claw portion 156 when the latch 157 is pivoted about the latch supporting shaft 155 does not overlap the tooth portions 154. Accordingly, it is possible to reduce the magnitude of the drive force required for the operation of displacing the latch 157 from the engaged position to the release position, that is, the return operation.

Mounted on top of the movable base main body 147 is the electromagnetic actuator 43 of the same construction as that of Embodiment 1. A movable rod 158 capable of reciprocating with respect to the electromagnetic actuator 43 extends horizontally from the electromagnetic actuator 43. The movable rod 158 is horizontally reciprocated through the drive of the electromagnetic actuator 43. A slot 163 is provided at the distal end portion of the movable rod 158. Fixed to the latch 157 is a latch mounting member 159 slidably fitted in the slot 163. The latch 157 is displaced into the engaged position as the movable rod 158 advances, and is displaced into the release position as the movable rod 158 retracts.

When the latch 157 is in the release position, the movable base main body 147 is supported in a balanced manner by the support link 144 and the displacement lever 145, and the pressing shoe 152 is displaced into the disengaged position. Further, in the state in which the ratchet gear 153 is being rotated in the direction in which the car 3 is being lowered (in the state in which the ratchet gear 153 is being rotated in the direction C in the figure), when the latch 157 is displaced into the engaged position, due to the rotation force of the ratchet gear 153, the movable base main body 147 is displaced in the direction (leftwards in the figure with respect to the frame member 41) for causing the pressing shoe 152 to be displaced into the restraining position.

It should be noted that the frame member 41 is provided with a first stopper 160 and a second stopper 161 which restrict the pivotal movement of the support link 144. With the first stopper 160 restricting the pivotal movement of the support link 144, it is possible to prevent the pressing shoe 152 from being moved away from the governor sheave 8 more than necessary. Further, with the second stopper 161 restricting the pivotal movement of the support link 144, the force with which the pressing shoe 152 is pressed onto the governor sheave 8 side can be prevented from increasing more than necessary, thereby reducing damage to the governor rope 9.

Next, the operation of the rope catching device will be. described. During the normal operation, the movable rod 158 is retracted and thus the latch 157 is displaced into the release position. Further, the pressing shoe 152 is placed in the disengaged position. At this time, the support link 144 is in abutment with the first stopper 160.

When the rotation speeds of the governor sheave 8 and ratchet gear 153 become abnormal, and the activation signal from the control device 12 is inputted to the electromagnetic actuator 43, the movable rod 158 is advanced, so the latch 157 is displaced into the engaged position. As a result, the tooth portion 154 of the ratchet gear 153 is engaged with the latch 157.

Thereafter, due to the rotation force of the ratchet gear 153, the movable base main body 147 is displaced leftwards in the figure against the frame member 41, so the pressing shoe 152 is displaced into the restraining position. At this time, as it is urged by the compression spring 151, the pressing shoe 152 is pressed against the governor sheave 8 through the governor rope 9. The governor rope 9 is thus restrained. The pressing force of the pressing shoe 152 is rendered appropriate through the abutment of the support link 144 against the second stopper 161. The subsequent operations are the same as those of Embodiment 1.

In the safety device for an elevator as described above, when the latch 157 that operates in an interlocking relation with the pressing shoe 152 is engaged with the ratchet gear 153, the rotation force of the ratchet gear 153 causes the pressing shoe 152 to be displaced toward the restraining position. Accordingly, the rotation force of the ratchet gear 153 can be utilized for restraining the governor rope 9, whereby the rope catching device can be activated with a small drive force.

While in Embodiments 4 through 6 described above the movable rod is displaced by the electromagnetic actuator 43 of the same construction as that of Embodiment 1, the movable rod may be displaced by the electromagnetic actuator 81 of the same construction as that of Embodiment 3.

The invention claimed is:

1. An emergency stop system for an elevator, composing:

a detection portion for detecting a speed and a position of a car;

a control portion having a storage portion that stores, in correspondence with the position of the car, an overspeed setting level set to be a value larger than the speed of the car during normal operation, the control portion outputting an activation signal when the speed of the car becomes higher than the overspeed setting level at the position of the car obtained based on information from the detection portion, and the overspeed setting level progressively varies based on a distance between the position of the car and a service floor;

a governor rope that moves in synchronism with raising and lowering of the car and is wound around a governor sheave, wherein the detection portion is provided to the governor sheave around which the governor rope is wound;

a rope catching device having an electromagnetic actuator that is activated upon input of the activation signal, a restraining portion that restrains the governor rope upon activation of the electromagnetic actuator, and a ratchet gear rotated integrally with the governor sheave; and a braking portion mounted in the car and having a braking member capable of coming into and out of contact with a guide rail for guiding the car, the braking portion braking the car by pressing the braking member against the guide rail when the governor rope is restrained and the car is displaced with respect to the governor rope, wherein the restraining portion is a pressing member capable of displacement into and out of contact with the governor sheave, and the pressing member is pressed against the governor sheave through the governor rope upon activation of the electromagnetic actuator.

2. An emergency stop system for an elevator according to claim 1, wherein:

a hoistway in which the car is raised and lowered is provided with a zone in which the car is accelerated or decelerated during normal operation and which adjoins the service floor for the car; and the overspeed setting level in the zone is set to become progressively smaller toward the service floor.

3. An emergency stop system for an elevator according to claim 2, wherein a reference position detecting portion is provided in the zone, for detecting a position that serves as a reference for detecting the position of the car by the detection portion.

4. An emergency stop system for an elevator according to claim 1, wherein the electromagnetic actuator has:

a movable portion displaceable between an activation position where the restraining portion restrains the governor rope and a release position for releasing the restraining of the governor rope;

an activation coil for displacing the movable portion into the activation position upon energization of the activation coil;

a release coil for displacing the movable portion into the release position upon energization of the release coil; and a permanent magnet for selectively retaining the movable portion in the activation position and the release position.

5. An emergency stop system for an elevator according to claim 1, wherein:

the rope catching device further has a latch operating in an interlocking relation with the pressing member and capable of coming into engagement with the ratchet gear upon activation of the electromagnetic actuator; and when the latch is engaged with the ratchet gear by the electromagnetic actuator, the pressing member is displaced due to a rotation force of the ratchet gear to be pressed against the governor sheave through the governor rope.

6. An emergency stop system for an elevator according to claim 1, wherein:

a hoistway in which the car is raised and lowered includes a first speed changing zone, a constant speed zone, and a second speed changing zone, the overspeed setting level becomes progressively smaller toward the service floor when the car is in the first speed changing zone or the second speed changing zone, and the overspeed setting level is constant when the car is in the constant speed zone.

7. An emergency stop system for an elevator according to claim 1, wherein the storage portion stores a normal speed pattern, and the overspeed setting level stored in the storage portion includes a first overspeed pattern and a second overspeed pattern, and each of the normal speed pattern, first overspeed pattern, and second overspeed pattern progressively vary based on the distance between the position of the car and the service floor.

8. An emergency stop system for an elevator according to claim 7, wherein:

a hoistway in which the car is raised and lowered includes a first speed changing zone, a constant speed zone, and a second speed changing zone, each of the normal speed pattern, the first overspeed pattern, and the second overspeed pattern becomes progressively smaller toward the service floor when the car is in the first speed changing zone or the second speed changing zone, and each of the normal speed pattern, the first overspeed pattern, and the second overspeed pattern is constant when the car is in the constant speed zone.

9. An emergency stop system for an elevator according to claim 7, wherein the control portion is configured to set a normal speed of the car based on the normal speed pattern, activate a normal brake when the speed of the car becomes higher than the first overspeed level, and output the activation signal when the speed of the car becomes higher than the second overspeed level.

10. An emergency stop system for an elevator according to claim 7, wherein the second overspeed pattern is greater than the first overspeed pattern and the first overspeed pattern is greater than the normal speed pattern at each position of the car.

11. An emergency stop system for an elevator according to claim 7, wherein a difference between the first overspeed pattern and the normal speed pattern, and a difference between the second overspeed pattern and the first overspeed pattern are each set to be substantially constant at each position of the car.

12. An emergency stop system for an elevator according to claim 1, wherein the control portion is configured to compute the overspeed setting level each time the elevator travels.

* * * * *